US006219507B1

(12) United States Patent
Yoneda et al.

(10) Patent No.: US 6,219,507 B1
(45) Date of Patent: Apr. 17, 2001

(54) IMAGE PROCESSING APPARATUS WITH ATTACHABLE/DETACHABLE FUNCTIONAL UNITS

(75) Inventors: Yoshiharu Yoneda; Tatsuya Inoue, both of Nara; Hiroyuki Nagao, Yamabe-gun; Shinji Sugita, Yamatokoriyama; Hiranaga Yamamoto, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/209,708

(22) Filed: Dec. 11, 1998

(30) Foreign Application Priority Data

Dec. 18, 1997 (JP) ..... 9-349731
Dec. 19, 1997 (JP) ..... 9-351081

(51) Int. Cl.[7] ..... G03G 15/00
(52) U.S. Cl. ..... 399/110; 399/113
(58) Field of Search ..... 399/110, 111, 399/113, 125, 120, 392, 367; 271/9.09, 164

(56) References Cited

U.S. PATENT DOCUMENTS

| | | | | |
|---|---|---|---|---|
| 4,436,406 | * | 3/1984 | Murasaki et al. | 399/392 |
| 4,925,062 | | 5/1990 | Tasukamoto et al. | 271/115 |
| 4,943,828 | * | 7/1990 | Manabe et al. | 399/113 |
| 5,440,373 | * | 8/1995 | Deki et al. | 399/113 |
| 5,745,824 | * | 4/1998 | Yashiro | 399/113 |
| 5,752,137 | * | 5/1998 | Haneda | 399/113 X |
| 5,887,228 | * | 3/1999 | Motohashi et al. | 399/111 |
| 6,085,051 | * | 7/2000 | Miyasaka et al. | 399/110 |

FOREIGN PATENT DOCUMENTS

| | | |
|---|---|---|
| 58-126460 | 8/1983 | (JP) . |
| 6-71947 | 9/1994 | (JP) . |

* cited by examiner

*Primary Examiner*—Quana M. Grainger
(74) *Attorney, Agent, or Firm*—Renner, Otto, Boisselle & Sklar, LLP

(57) ABSTRACT

When the manual feeder and developer collecting container is attached to the copier body, there is a space which is formed by translating the developer collecting container in the attaching direction (the B-direction) of the developer collecting container, between the developer collecting container and the rear frame. The manual feeder is attached so that part of the manual feeder is disposed in this space. The attached developer collecting container, is arranged out side of a space which is the paths of the manual feeder for movement in the X-direction and in the Y-direction. The attached manual feeder is disposed outside the space which is the path of the developer collecting container. A lever as a shifting element of shifting a pickup feeding element between active and inactive positions resides in a space defined by translating the mid area across the full sheet width of the acceptable maximum size, in the direction of the sheet thickness. The space of the path of the pickup feeding element for movement between the active and inactive positions, is arranged so as to be in contact with the two planes normal to the direction of the sheet thickness, and the lever resides within this space. This lever is extended to a space defined by translating a boundary area of the full sheet width of the acceptable maximum size in the direction of the sheet thickness so that the extended portion is coupled to a pickup solenoid as the movement drive source for the pickup feeder.

38 Claims, 24 Drawing Sheets

IMAGE PROCESSING APPARATUS WITH ATTACHABLE/DETACHABLE FUNCTIONAL UNITS

BACKGROUND OF THE INVENTION (1) Field of the Invention

The present invention relates to an image information processing apparatus such as a copier, printer, facsimile machine, scanner and the like as well as relating to a sheet feeder usable in an image information processing apparatus and having a function of feeding sheets, one by one, from a stack of sheets.

(2) Description of the Related Art

Concerning image information processing apparatuses including: a copier which scans the image of an original and produces a printed output of the scanned image information; a printer which produces a printed output of transferred image information; a facsimile machine which transmits the image information obtained by scanning the image of an original; and a scanner which scans the image of an original to obtain its image information and the like, wasted interior space is attempted to be reduced as much as possible to make the image information processor compact. However, when miniaturizing, simply reducing the space is not effective enough, it is necessary to develop the miniaturization whilst securing necessary space, without any deterioration of the functions and operativities as much as possible.

For example, in order to enable maintenance, checks, adjustment, repair etc. of an image processing apparatus, Japanese Utility Model Laid-Open Application Sho 58 No. 126,460 discloses an image processing apparatus in which its functional units can be detachably attached from two adjoining sides thereof. In this prior art, when the detachable photosensitive member unit is attached or detached from the top of the image processing apparatus, the functional unit, located below the photosensitive member inside the image processing apparatus and having functional parts, are shifted to the side of the image processing apparatus while the developing unit is pulled out of the top, so as to create an open space around the photosensitive member for its attachment and detachment. Thus, the photosensitive member is attached or detached.

Concerning this technology, in order to improve the easiness of the attachment and detachment by reducing the number of working steps upon attachment and detachment, it is possible to configure an arrangement in which the photosensitive member can be attached and detached from the top of the image processing apparatus without shifting the functional unit, including the functional part located below the photosensitive member, to the side of the image processing apparatus. Illustratively, the functional parts, including the photosensitive member, located above the photosensitive member are integrated into a single functional unit so that the unit can be attached or detached from the top of the image processing apparatus. In such an image processing apparatus, it is necessary to develop miniaturization without compromising the attachment and detachment performance.

However, in the case where the image processing apparatus having detachable functional blocks, disclosed in Japanese Utility Model Laid-Open Application Sho 58 No. 126,460 is miniaturized, in order to effect the function in the functional unit, the parts inevitably residing at their predetermined positions are kept as they are while parts other than the above-mentioned parts are configured to be moved. Further, in order to avoid interference of one functional unit with an adjacent one during attachment and detachment thereof, each functional unit is configured so as not to have any projection which would be an obstacle to the attaching or detaching movement of an adjacent functional unit and hence the functional unit is preferably configured so that the width of the space required for attachment and detachment may be substantially uniform. Therefore, the overall shape of functional units tends to be a rectangular prism. However, if the functional units are limited to this shape, they produce wasted space. In this way, it was not possible to reduce the volume of the space occupied by the functional units, and hence it was not promoted to miniaturize of the image processing apparatus. This problem becomes marked for the functional units having functions relating to the sheets, such as an exposure scanner unit, sheet feeding unit, image forming unit, fixing unit and the like.

For miniaturization of the image information processing apparatus, the following two points are of importance:

(1) To miniaturize individual parts; and (2) To eliminate the wasted space within the image information processing apparatus as much as possible. However, the first point 'miniaturization of individual parts' can be attained only to a limited extent, limited by the fact that each part should present the specified functionality expected by the design requirements.

For the purpose of explanation, a feed roller in a sheet feeding device having the function of separating and feeding sheets, one by one, from a stack of sheets will be a typical example. The sheet feeding performance of a feed roller varies widely depending upon the size of the sheets (length, width and thickness), the characteristics of sheets (friction coefficient with respect to the feed roller and the stiffness) or the environment under which sheets are handled by the feeder. Therefore, in order to expect a stable sheet feeding performance for handling a variety of sheet types under various environment conditions, the feed roller needs certain minimum dimensions. For example, to prevent skew during feeding, the feed roller needs to abut the sheet with a predetermined nipping length or greater, which means that the feed roller needs to be longer than a predetermined length. To separate sheets, one by one, the feed roller needs to abut the sheet with a predetermined nipping width or greater, which means that the diameter and the rubber thickness of the feed roller need to be greater than predetermined values.

Concerning the sheet stopper means of a sheet feeder for preventing the stack of sheets from reaching the feed roller, this device needs to move and retract from the sheet blocking position when a sheet needs to be delivered. Therefore, the movable distance of the stopper is determined by the height of the stack of sheets to be allowed. As for some examples of the functional parts disposed in the image forming units, such as the photosensitive member, the developing roller in the developing unit, the cleaning blade, the charger, the transfer device, etc., the sizes of these elements are determined by the maximum size of sheets to be handled since image forming needs to be done for the sheets of the acceptable maximum size.

In this way, not only the functional parts directly acting on the sheets, such as the feed roller, photosensitive member, charger, transfer device etc., but also the functional parts indirectly acting on the sheets, such as the developing roller, cleaning blade etc., will be determined as to their dimensions by the size of the sheets to be handled. Further, similar to the sheet stopper means, there are functional parts having a predetermined movable range. But the movable range is also determined depending on the sheets. Accordingly, these functional parts relating to the sheets, because they relate to sheets, may be modified as to their dimensions and their positional relationship relative to the sheets, to some permissible extent depending upon their relationship with the sheets, but still cannot be said to have a large flexibility in their design.

On the other hand, parts other than the functional parts relating to the sheets, such as, the drive transmitting parts for transmitting driving force to the functional parts relating to the sheets, support parts and casings for accommodating functional parts relating to the sheets, drive sources, parts for electrical connections and the like, are rather flexible in design with regard to miniaturization and their layout, compared to the functional parts relating to the sheets.

Next, the second point, 'elimination of the wasted space within the image information processing apparatus as much as possible' will be discussed.

In the interior of an image information processing apparatus, there are many functional units which each can be attached and pulled out integrally and still have both the functional parts relating to the sheets and the other parts. Each functional unit having these functional parts relating to the sheets tends to have unused spaces, but these spaces are scattered. Therefore, the volume of unused spaces unnecessarily has made the image information processing apparatus bulky.

Further, due to the possibility of malfunction from the increase of the number of working steps and complexity of working procedures at attachment and detachment of a functional unit, the simplest handling during attachment and detachment of the functional unit is the main matter of interest during design. As a result of this, if a functional unit has a projected portion in the mid part thereof with respect to the direction of the sheet width, around other adjacent components in the image information processing apparatus, the functional unit is disposed apart from other adjacent components so that the projected portion will not interfere when it is attached and detached. Accordingly, wasted space arises between adjacent functional units; this has also made the image information processing apparatus bulky.

The above described problem will now be described taking a specific example of a sheet feeder comprising a pickup feeding means, a separation feeding means and a sheet stopper means, all being the functional parts directly acting on sheets.

A sheet feeder for separating and feeding sheets, one by one, from a stack of sheets placed on a sheet stacking means, in the downstream direction with respect to its conveyance, is disclosed in Japanese Patent Publication Hei 6 No. 71,947. In this sheet feeder, the pickup feeding means is disposed on the upstream side of the separation feeding means for separating sheets, one by one, with respect to the sheet conveying direction, and the pickup feeding means moves from a position away from the top of the sheet stack on the sheet stacking means, to the abutting position on the sheet stack so as to deliver a sheet toward the sheet separation feeding means. The pickup feeding means of this sheet feeder is configured to move up and down as it rotates about a rotary axle.

In general, since such a sheet feeder handles sheets of regular sizes, it is not possible to reduce the dimensions with respect to the planer directions of the sheets, to smaller than the maximum size of the sheets to be handled, but a miniaturization (development of a thinner configuration) can be expected with respect to the direction of the sheet thickness.

Now, the development of thinning a sheet feeder having an up-and-down moving type pickup feeding means, disclosed in Japanese Patent Publication Hei 6 No. 71,947 will be considered. When considering the facts that the dimensions of the separation feeding means and pickup feeding means are considerably smaller than the maximum acceptable sheet size and that the pickup feeding means moves up and down, the sheet feeder tends to have wasted space on both sides of the pickup feeding means with respect to the direction perpendicular to the sheet conveying direction. Since other devices and components also tend to occupy a considerably large space in the central portion with respect to the direction perpendicular to the sheet feeding direction within the image processor, it is difficult to lay out devices and components other than the sheet feeder, in the spaces on both sides of the pickup feeding means because of the consideration of attaching and detaching performance of the devices and components disposed inside the image processing apparatus.

When the up-and-down driver and/or drive source of the pickup feeding means were laid out on both sides of the pickup feeding means, the up and down driver and drive source, in general, were arranged in both sides of the pickup feeding means with respect to the direction perpendicular to the sheet feeding direction, rather near the center in proximity to the pickup feeding means. Accordingly, this up-and-down driver and drive source were the obstacles to further miniaturization.

Further, the pickup feeding means and sheet stopper means disclosed in Japanese Patent Publication Hei 6 No. 71,947, are configured so as to move between the active position where they act on the sheets and the inactive position where they are away from the sheets. The pickup feeding means, separation feeding means and sheet stopper means do not extend across the full width of the acceptable maximum sheet size, but are formed with certain dimensions, with respect to the direction of the sheet width, which are shorter than the maximum sheet width. On the other hand, with regards to the direction of the sheet thickness, since the pickup feeding means and sheet stopper means move up and down, the spaces occupied by these components, when considering the space of their movable ranges, are bulky in their mid parts compared to other parts. If another functional unit needs to be disposed adjoining this sheet feeder, the functional unit must be arranged apart therefrom so that the space for movement of this functional unit will not interfere with this bulged portion of the sheet feeder. This produces wasted space.

In the sheet feeder disclosed in Japanese Patent Publication Hei 6 No. 71,947, the mechanism for shifting the positions of the pickup feeding means (pickup roller) and the sheet stopper means (shutter 12), are arranged close to the pickup feeding means and the sheet stopper means with respect to the direction of the sheet width. Further, the mechanism for transmitting a driving force for moving the stopper means, is constructed so that the driving force from the drive source is transmitted by combination of a rotary transmitting element and a rotary drive transmitting element (in Japanese Patent Publication Hei 6 No. 71,947, the drive transmitting element of the pickup feeding means is a first cam 39 while the drive transmitting element of the sheet stopper means is a second cam 72). Because of these arrangements, the shifting mechanism is comparable to or greater in size than the pickup feeding means and sheet stopper means.

Next, another case will be explained in which a rotary drive transmitting element and a solenoid as the drive source are arranged adjacent to a pickup feeding means with respect to the direction of the sheet width. Now, the factors hindering the development of a thinner configuration of the sheet feeder with respect to the direction of the sheet thickness will be described with reference to FIGS. 1 and 2.

FIG. 1 is a perspective view showing a sheet feeder in a conventional copier, and FIGS. 2A and 2B are sectional views of the operating states of this sheet feeder. FIG. 2A shows the case where the pickup feeding device is in its non-pickup state, and FIG. 2B shows the case where the pickup feeding device is in its pickup state.

In this manual feeder, a pickup feeding means 152 picks up sheets P from a stack of sheets placed on a sheet stacking means 151 to a separation feeding means 153, where the sheets are separated and fed, one by one, towards the downstream side with respect to the sheet conveying direction.

Pickup feeding means 152 is rotatably supported about a rotary shaft, i.e., drive input shaft 701 by means of support members including the rotary shaft, support arms 700 for supporting the rotary shaft and a coupling plate 705 for coupling the arms. Pickup feeding means 152 is configured so that it can be moved by a solenoid 702, a return spring 703, a rotary shift lever 704 and an urging spring 706, between the active position where the pickup feeding means abuts sheets P stacked on the sheet stacker and the inactive position where it is kept away from sheets P. This configuration is further detailed below.

Rotary shift lever 704 can be engaged with part of the supporting means (coupling plate 705 in this case) of pickup feeding means 152. When solenoid 702 is activated, rotary shift lever 704 rotates counterclockwise in FIG. 2, opposing the elastic force of return spring 703 so as to disengage the supporting means of pickup feeding means 152. Upon this disengagement, the rotatably supported pickup feeding means 152 comes down due to gravity acting on the support members and pickup feeding means 152 itself and due to elastic force of urging spring 706 so as to press sheets P (at the active position) enabling the feed of the sheets.

When solenoid 702 is deactivated, rotary shift lever 704 is turned clockwise in FIG. 2 by the elastic force of return spring 703, and separates pickup feeding means 152 away from the sheets and returns it to the inactive position, opposing the gravity acting on pickup feeding means 152 itself and the support members and the elastic force of urging spring 706.

Suppose that solenoid 702 is designed so as to be activated to output a driving force to rotate the rotatable portion rotating integrally with pickup feeding means 152 upperwards and hence separate pickup feeding means 152 from the sheet. In this case, an elastic means such as a spring etc., urging pickup feeding means 152 toward the sheets is needed, so the driving force needs to oppose the urging force from the elastic means urging the pickup feeding means 152 toward the sheets and also oppose gravity acting on the portion integrally rotating with pickup feeding means 152. Under consideration of this fact and also considering the duty ratio of solenoid 702 or the activation of solenoid 702 when the manual feeder is not used, the solenoid 702 inevitably needs to be made large or high powered. Therefore, to avoid this situation, solenoid 702 is adapted to become active when the manual feeder is used, so that the portion rotating integrally with pickup feeding means 152 is designed to move upwards by means of spring 703 coupled to shift lever 704. In this case, solenoid 702 only needs to have a driving force for rotating the shift lever, opposing only spring 703, so a low powered solenoid 702 is adequate for this operation.

Depending upon the length of active duration of solenoid 702 and/or the size of solenoid 702, the following limitations need to be imposed for making solenoid 702 compact.

That is, when solenoid 702 is directly coupled with rotary shift lever 704 as stated above, the solenoid needs be active when pickup feeding means 152 moves to the active position (since the time during which the solenoid is in the inactive position is overwhelmingly longer than that in the active position). For this purpose, the plunger which is at the mid point of the height of solenoid 702 must rotate rotary shift lever 704 in the counterclockwise direction so that the plunger is disposed below the rotary shaft of rotary shift lever 704.

As seen from FIG. 2, if the location of the solenoid 702 is set downward, the open space for passing the sheet therethrough becomes narrow. So it is impossible to dispose solenoid 702 and rotary shift lever 704 below the space for stacking sheets. Yet, pickup feeding means 152 needs to be configured so as to move down to sheet stacker 151.

Even if a solenoid 702 of a compact type is used, the size is considerably larger when compared to the size of pickup feeding means 152.

Because of these conditions and requirements, rotary shift lever 704 and solenoid 702 will project upwards above the level of pickup feeding means 152 when it is positioned at its highest position, i.e., the inactive position. Accordingly, the actual height of the sheet feeder, with respect to the direction of the sheet thickness becomes greater by the dimension of the aforementioned projection.

In FIG. 1, the driving force for turning separation feeding means 153 and pickup feeding means 152 when feeding sheets is input from the machine body side by means of a clutch etc.

Next, the sheet stopper means as a functional part which is disposed in the sheet feeder and moves between the active position and inactive position will be described.

When sheets are stacked on the sheet stacking means, the sheets are pushed in to the position of the sheet separation feeding means. The sheet stopper means of the sheet feeder is to prevent erroneous feed such as multifeed and the like when sheet feeding is started. Therefore, the stopper means needs to be positioned on the upstream side, with respect to the sheet conveying direction, of the separation feeding means. On the other hand, the stopper means needs to be laid out on the downstream side, with respect to the sheet conveying direction, of the pickup feeding means, in order to enable the pickup feeding means to feed the topmost sheet from the sheet stacking means when sheet feed is started. Accordingly, the stopper means is arranged between the pickup feeding means and separation feeding means. In the case of a feeder of this mechanism, the pickup feeding means is supported by the support assembly so as to come into and out of contact with the sheets. Therefore, as disclosed in Japanese Patent Publication Hei 6 No. 71,947, the known stopper means is configured to be coupled with the support assembly pivotally provided on the separation feeding means side so as to go from above the sheet stacking means down to between the pickup feeding means and separation feeding means.

The use of this mechanism, however, makes the sheet feeder thicker with respect to the direction of the sheet thickness because the support assembly of the stopper means rotates and moves over the separation feeding means. Further, since the sheet stopper means is configured to rotate and move up and down, when a stack of sheets is placed on the sheet stacking means, the stopper means is liable to move upwards when pressed by the sheets, which would cause mal-feeding of sheets.

Up to now, negative factors in miniaturizing the sheet feeder which moves between the active and inactive positions were discussed. All the other functional units of the image information processing apparatus have hindering factors against their miniaturization.

For solving the above problems concerned with miniaturization of the image information processing apparatus, it is necessary to improve the design flexibility of each functional unit having functional parts relating to the sheets, especially that of the parts other than functional parts relating to the sheets in that unit. More specifically, it is necessary to prevent the parts other than functional parts relating to the sheets from becoming projected into the center with respect to the direction of the sheet width, and hence prevent functional units from becoming bulky. That is, it is necessary to design the layout so that parts other than functional parts relating to the sheets will not produce wasteful space between adjoining functional units.

SUMMARY OF THE INVENTION

It is therefore a first object of the present invention to provide a compact image processing apparatus which is reduced in wasted space without lowering the functions and working performances and the like.

It is a second object of the present invention to provide a sheet feeder which can be thinned with respect to the direction of the sheet thickness and can be used to promote miniaturization of the image information processing apparatus, keeping its sheet feeding performance and attaching and detaching performance of functional units.

In order to achieve the above objects, the present invention is configured as follows:

In accordance with the first aspect of the invention, an image processing apparatus, comprises: a plurality of functional units each having a predetermined function for processing an image, disposed in a predetermined position so as to be attachable and detachable with respect to the apparatus body, and is characterized in that each functional unit is disposed and attached in a space excepting a space which is the path of any other unit during movement for attachment and detachment thereof; and a space defined by translating a first functional unit in the attaching direction thereof can accommodate a part of a second functional unit.

In accordance with the second aspect of the invention, an image processing apparatus, comprises: a plurality of functional units each having a predetermined function for processing an image, disposed in a predetermined position so as to be attachable and detachable with respect to the apparatus body, and is characterized in that each functional unit is disposed and attached in a space excepting a space which is the path of any other unit during movement for attachment and detachment thereof; and a space defined by crossing of a space defined by translating a first functional unit in the attaching direction thereof and a space defined by translating the first functional unit in the detaching direction of a second functional unit can accommodate a part of the second functional unit.

In accordance with the third aspect of the invention, an image processing apparatus comprises: a plurality of functional units each having a predetermined function for processing an image, disposed in a predetermined position so as to be attachable and detachable with respect to the apparatus body, and is characterized in that each functional unit is disposed and attached in a space excepting a space which is the path of any other unit during movement for attachment and detachment thereof; and a space defined by overlapping of a space defined by translating a first functional unit in the attaching direction thereof and a space defined by translating the first functional unit in a direction substantially perpendicular to the attaching direction thereof, excluding a space occupied by the first functional unit, can accommodate a part of the second functional unit.

In accordance with the fourth aspect of the invention, the image processing apparatus having the above first through third features is characterized in that one of the multiple functional units has a first functional portion which directly comes in contact with the sheets and directly relates to sheet feeding and a second functional portion which relates to sheet feeding but is kept away the sheets; the first functional unit is arranged for attachment within a space which is defined by translating an area extending in the direction perpendicular to sheet feeding direction and having the full width of the acceptable maximum size sheet, in the direction normal to the sheet feeding surface; and/or the second functional unit is arranged for attachment within a space which is defined by translating an area lying in the direction perpendicular to sheet feeding direction but outside the full width of the acceptable maximum size sheet, in the direction normal to the sheet feeding surface.

In accordance with the fifth aspect of the invention, the image processing apparatus having the above first through third features is characterized in that the first functional unit has a coupling means for coupling with the apparatus body or any other functional unit and at least a part of the coupling means disposed in a second functional unit.

In accordance with the sixth aspect of the invention, the image processing apparatus having the above fifth feature is characterized in that multiple coupling means are classified and partitioned on the basis of the types of the coupling means.

In accordance with the seventh aspect of the invention, the image processing apparatus having the above first through third features is characterized in that the first functional unit is a container which can be modified in volume.

In accordance with the above first through seventh features, in the space of the path for movement of a functional unit when it is attached or detached, no part of other functional units are located other than the functional unit which is being attached or detached. Therefore, when the functional unit is attached or detached, no manipulative operation is needed such as moving, attaching and detaching any other functional unit. For example, for attachment or detachment of a functional unit, a simple attachment and detachment of a functional unit can be ensured without needing any increase of steps relating to attachment and detachment, unlike a configuration in which a certain functional unit is attached or detached, other units are needed to be moved once in a certain direction, and then moved in another direction. Wasted space which tends to arise when functional units are configured in substantially rectangular prism forms, can be reduced by changing the arrangement of the parts within each functional unit, thus making it possible to reduce the volume of the space occupied by the functional unit itself. This contributes to miniaturization of the 22 image processing apparatus.

In accordance with the eighth aspect of the invention, a sheet feeder comprises:

- a sheet stacking means for stacking sheets;
- a sheet-feeding related means which is movable between the active position of the sheet feeding action and the inactive position unrelated to the sheet feeding action; and
- a transmitting element for transmitting the driving force for moving the sheet-feeding related means between the active position and inactive position, and is characterized in that, when, in a space defined by translating the mid area of the full width of the acceptable maximum size sheet to be set on the sheet stacking means in the direction of the sheet thickness of the sheets stacked on the sheet stacking means, a space of the path of the sheet feeding related means for movement between its active and inactive positions, is arranged between two planes perpendicular to the direction of the sheet thickness, the transmitting element is arranged in the space enclosed by two planes; and the transmitting element is extended to a space which is defined by translating a boundary area of the full width of the acceptable maximum size sheet to be set on the sheet stacking means in the direction of the sheet thickness, or is extended to a space which is defined by translating an area beyond the full width of the acceptable maximum size sheet to be set on the sheet stacking means in the direction of the sheet thickness.

In accordance with the ninth aspect of the invention, the sheet feeder having the above eighth feature is characterized in that the sheet stacking means, sheet feeding related means and transmitting element can be attached and detached with respect to the main body; a space overlapped between the space which is defined by translating a boundary area of the full width of the acceptable maximum size sheet to be set on the sheet stacking means, in the direction of the sheet thickness and/or the space which is defined by translating an area beyond the full width of the acceptable maximum size sheet to be set on the sheet stacking means, in the direction of the sheet thickness, and a space which is defined by translating the space of the path of the sheet feeding related means for movement between its active and inactive positions, in the direction of sheet width, is occupied by the transmitting element and a part of the drive source for driving the transmitting element.

In accordance with the tenth aspect of the invention, a sheet feeder comprises:

a sheet stacking means for stacking sheets;

a pickup feeding means which is supported by a supporting portion so as to be movable between a sheet feeding position where it comes in contact with the sheet stacked on the sheet stacking means and a retracted position where it is kept away from the sheet;

a first driving system, which provides a driving force to the supporting portion so as to shift the pickup feeding means between the sheet feeding position and the retracted position;

a second driving system for providing a driving force to the pickup feeding means;

a separation feeding means for separating the sheets which are fed by the pickup means, at the sheet feeding position, driven by the driving force from the second driving system, one by one, and delivering the separated sheet to the downstream side with respect to the sheet feeding direction;

a third driving system which provides a driving force to the separation feeding means to cause the separation feeding means to separate sheets, one by one; and a control means for controlling the first, second and third driving systems so that the sheets stacked on the sheet stacking means can be delivered, characterized in that the first driving system comprises:

a rotary driving force transmitting element and a parallel movement type driving force transmitting element coupled to the rotary driving force transmitting element, and the rotary driving force transmitting element is disposed closer to the pickup feeding means than the parallel movement type transmitting element.

In accordance with the eleventh aspect of the invention, the sheet feeder having the above tenth feature is characterized in that the first driving system further comprises an urging spring urging the parallel movement type driving force transmitting element, in the direction opposing the driving force from the drive source; and the urging spring is provided along the direction in which the parallel movement type transmitting element moves, and is engaged with the parallel movement type transmitting element.

In accordance with the twelfth aspect of the invention, the sheet feeder having the above tenth feature is characterized in that the first driving system further comprises a compression spring urging the rotary driving force transmitting element, in the direction opposing to the driving force from the drive source; and the compression spring is engaged between the fixed side and the rotary driving force transmitting element, via a rotatable supporting means.

In accordance with the thirteenth aspect of the invention, a sheet feeder comprises:

a sheet stacking means for stacking sheets;

a pickup feeding means which is supported by a supporting portion so as to be movable between a sheet feeding position where it comes in contact with the sheet stacked on the sheet stacking means and a retracted position where it is kept away from the sheet;

a first driving system, which provides a driving force to the supporting portion so as to shift the pickup feeding means between the sheet feeding position and the retracted position;

a second driving system for providing a driving force to the pickup feeding means;

a separation feeding means for separating the sheets which are by the pickup means, at the sheet feeding position, driven by the driving force from the second driving system, one by one, and delivering the separated sheet to the downstream side with respect to the sheet feeding direction;

a third driving system which provides a driving force to the separation feeding means to cause the separation feeding means to separate sheets, one by one;

a stopper means which is movable between the blocking position for stopping the sheets stacked on the sheet stacking means, from moving toward the separation feeding means, and the retracted position for allowing the sheets stacked on the sheet stacking means to be fed;

a fourth driving system for driving the stopper means between the blocking position and the retracted position; and a control means for controlling the first, second, third and fourth driving systems so that the sheets stacked on the sheet stacking means can be delivered, and is characterized in that the stopper means is lowered under the sheet stacking surface of the sheet stacking means when it is at the retracted position, and is moved in parallel in the direction crossing the sheet stacking surface when the stopper means moves between the blocking position and the retracted position.

In accordance with the fourteenth aspect of the invention, the sheet feeder having the above thirteenth feature is characterized in that the fourth driving system comprises a parallel movement type driving force transmitting element integrally provided on the side opposite to the sheet blocking side of the stopper means, and a rotary driving force transmitting element which abuts the parallel movement type driving force transmitting element to transmit the driving force; and when two planes perpendicular to the direction of the sheet thickness are formed so as to be in contact with a space of the path for movement of the stopper means between the blocking position and the retracted position, the rotary driving force transmitting element is arranged within the space enclosed by the two planes and in the side opposite to the sheet blocking side of the stopper means.

In accordance with the above configurations of the above eighth through fourteenth features, if a functional unit having functional parts relating to the sheets is arranged next to the sheet feeder, no wasted space will arise so that it is possible to promote miniaturization of the image information processing apparatus whilst keeping the attachment and detachment of the functional unit and the sheet feeder simple.

DESCRIPTION OF THE PREFERRED EMBODIMENTS

The embodiments of the invention will hereinafter be described with reference to the accompanying drawings.

(The First Embodiment)

Figure 1:
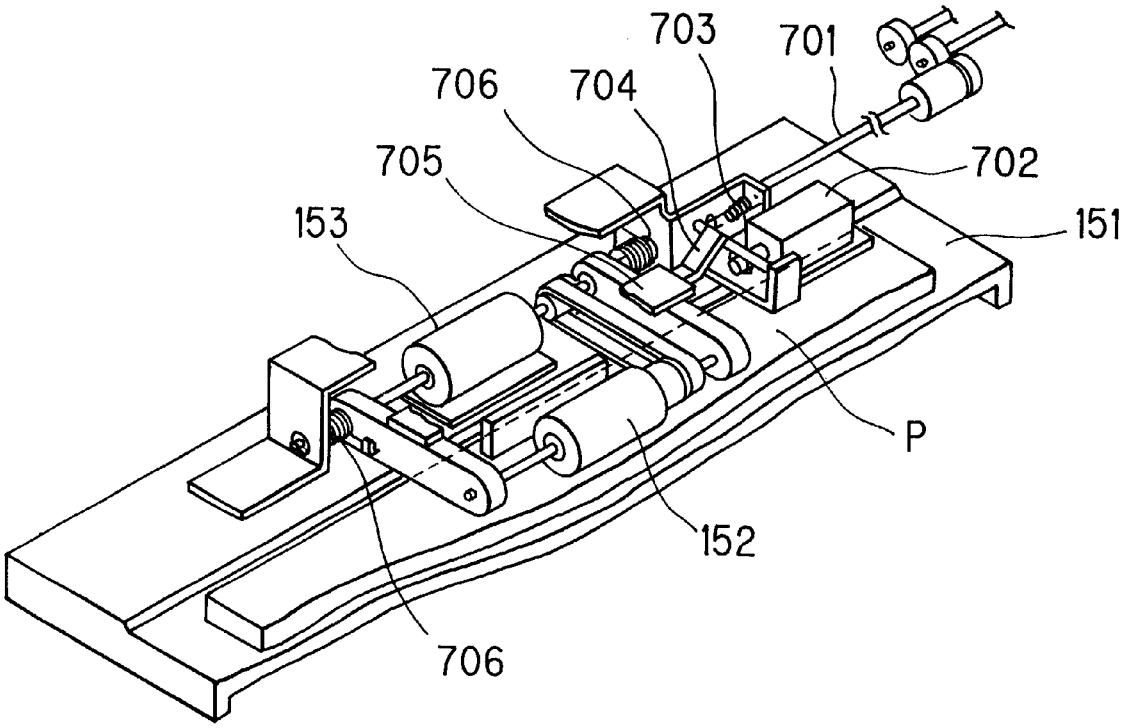
FIG. 1 PRIOR ART
FIG. 1 is a perspective view showing a sheet feeder portion of a conventional copier.
Figure 2A:
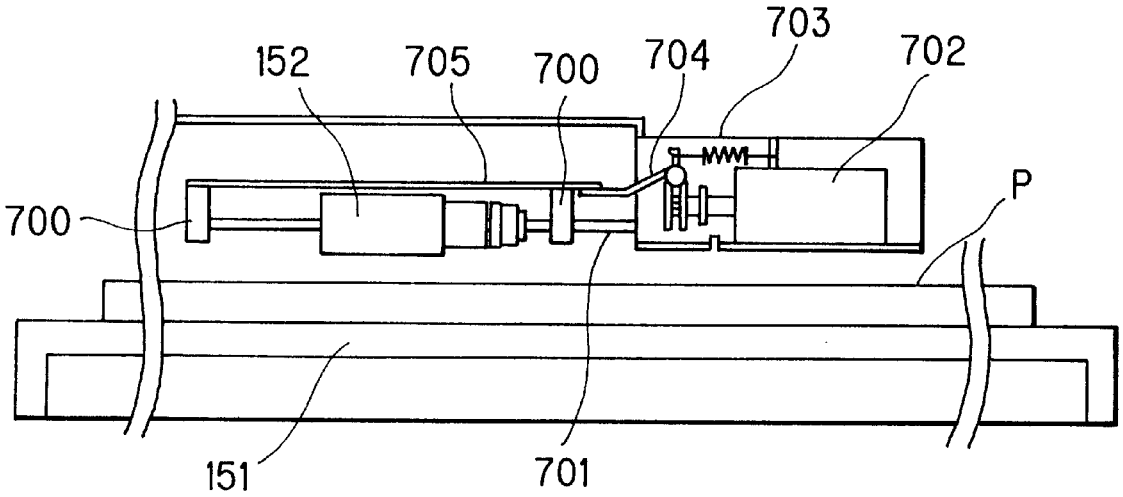
FIG. 2A PRIOR ART
FIGS. 2A and 2B are side views showing the sheet pickup states of a sheet feeder portion of a conventional copier.
Figure 2B:
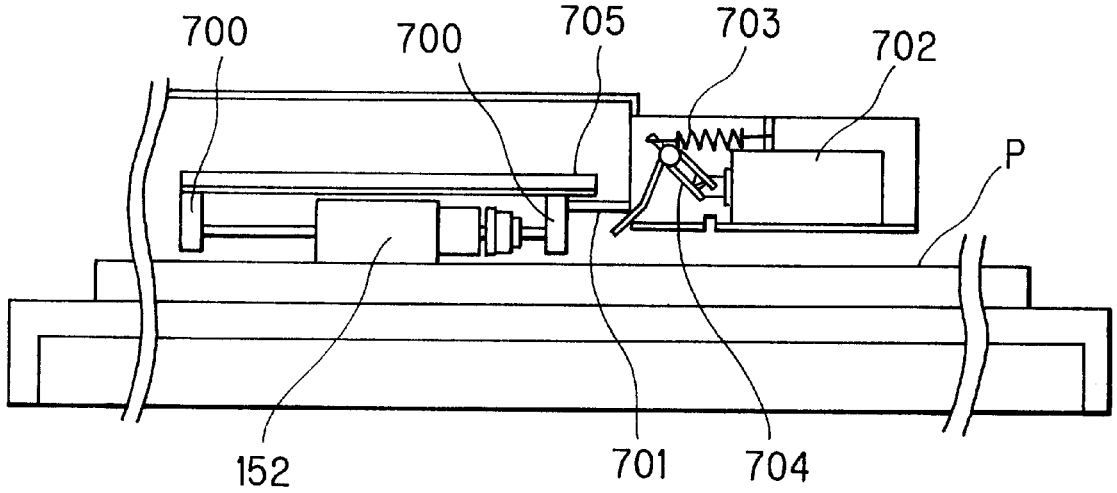
FIG. 2B PRIOR ART
Figure 3:
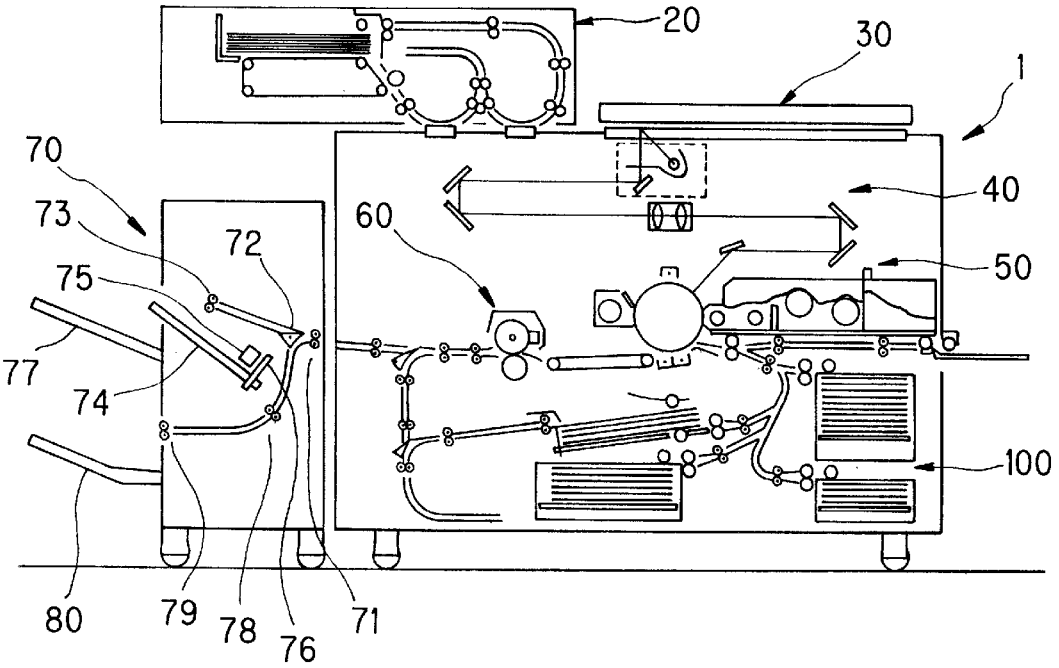
FIG. 3 is a main sectional view showing the first embodiment of a copier as an image processing apparatus in accordance with the invention.
Figure 4:
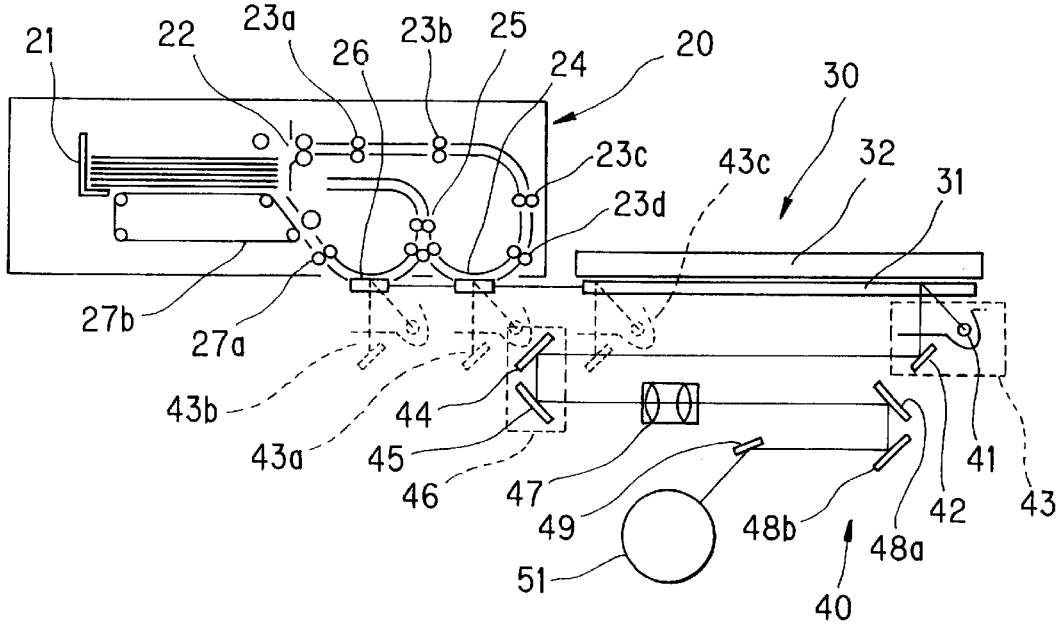
FIG. 4 is a schematic sectional view showing a circulating type automatic document feeder, a manual document setting device and an optical system.
Figure 5:
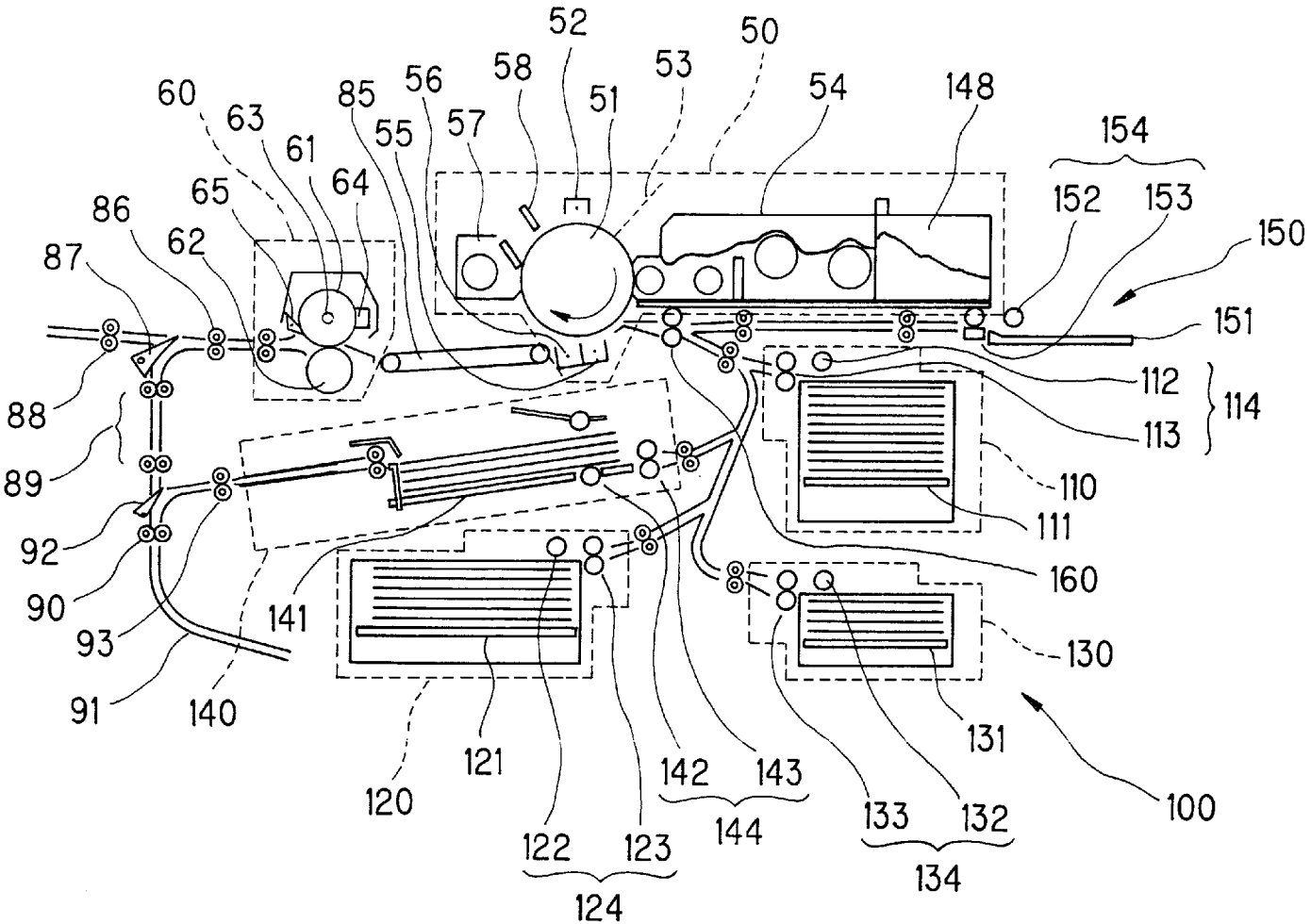
FIG. 5 is a schematic sectional view showing an image forming unit, a fixing unit and sheet feeders.

Referring to FIGS. 3 to 5, the configuration of a copier and its overall operation will be described hereinbelow. FIG. 3 is a main sectional view showing the first embodiment of a copier as an image processing apparatus in accordance with the invention. FIG. 4 is a schematic sectional view showing a circulating type automatic document feeder, a manual document setting device and an optical system. FIG. 5 is a schematic sectional view showing an image forming unit, a fixing unit and sheet feeders.

Referring first to FIG. 3, the overall configuration of the copier as an image processing apparatus will be described.

Provided above a copier body 1 are a circulating type automatic document feeder 20 and a manual original setting device 30 for manual setting of an original. Copier body 1 further includes: in the interior thereof, an optical system 40 in the upper portion thereof; an image forming unit 50 and a fixing unit 60 in the central portion thereof; and a sheet feeding unit 100 in the lower portion thereof. A post-processing unit 70 is arranged on the left side of copier body 1. The configuration of post-processing unit 70 will be described later.

Referring now to FIGS. 4 and 5, the basic configuration and overall operation of each unit will be described. As shown in FIG. 4, originals stacked on document stacker 21 of circulating type automatic document feeder 20 are separated, sheet by sheet, by original separation feeding means 22, and the original document is conveyed by document feed roller 23*a*, 23*b*, 23*c* and 23*d* to a first original exposure portion 24 made up of a transparent element such as contact glass or the like, so that one side of the original may face the first original exposure portion 24. After passing through the first original exposure portion 24, the original is turned upside down by means of an original inverting means 25 made up of a switchback mechanism, so that a face opposite to the face facing the first original exposure portion 24 will face a second original exposure portion 26. After passing through the second original exposure portion 26, the original is returned to the bottom of the originals stacked on document stacker 21 by means of document collecting means 27*a* and 27*b*. In this way, circulating type automatic document feeder 20 successively conveys the originals, passing through the first original exposure portion 24 and the second original exposure portion 26 whilst each original is being exposed and scanned by optical system 40, which will be detailed later. Thus, in this mode, travelling document type scanning is performed.

On the other hand, as shown in FIG. 4, manual original setting device 30 comprises a contact glass 31 and an original cover 32 provided so as to be openable upward, away from contact glass 31. For setting an original, the operator opens original cover 32 by hand, places the original at the original setting reference position on contact glass 31 and closes original cover 32. Thus, the original is pressed down onto contact glass 31 by original cover 32. In this manual original setting device 30, the original still set on contact glass 31 is exposed and scanned by optical system 40, which will be detailed hereinbelow. That is, in this mode document-still scanning is implemented.

As shown in FIG. 4, optical system 40 provided in the upper interior of copier body 1 comprises: a scanning unit 43 integrally composed of an exposure lamp 41 and a first mirror 42; a movable mirror unit 46 integrally composed of a second mirror 44 and a third mirror 45; a zooming lens 47; a fourth mirror 48*a*, a fifth mirror 48*b* and a sixth mirror 49. The reflected light from the original when the original is illuminated and scanned by exposure lamp 41 passes through first mirror 42, second mirror 44, third mirror 45, zooming lens 47, fourth mirror 48*a*, fifth mirror 48*b* and sixth mirror 49, and is lead to the surface of a photosensitive member 51, on which the original image is focused. This photosensitive member 51 will be explained below. When an original is scanned using circulating type automatic document feeder 20, while the original surface facing the first original exposure portion 24 is scanned, scanning unit 43 stands still at a standstill position 43a for the first original exposure portion so as to expose the original to light as it passes through the first original exposure portion 24. On the other hand, while the original surface facing the second original exposure portion 26 is scanned, scanning unit 43 stands still as another standstill position 43*b* for the second original exposure portion so as to expose the original to light as it passes through the second original exposure portion 26. When the surface of an original placed on the contact glass is scanned using manual original setting device 30, scanning unit 43 irradiates the original with light whilst moving from a ready position 43*c* on the left end of the contact glass to the right in the drawing, while movable mirror unit 46 moves in the same direction at half the speed of scanning unit 43.

As shown in FIG. 5, image forming unit 50 provided in the interior central portion of copier body 1 has photosensitive member 51. Around photosensitive member 51 in the rotational direction of the photosensitive member 51 (in the direction of the arrow A in FIG. 5) are arranged sequentially the important members such as a charger 52, an exposure light path 53, a developing means 54, a transfer device 55, a separation charger 56, a cleaner 57 and a charge erasing lamp 58 and the like. Charger 52 supplies charge onto the surface of photosensitive member 51 as it rotates so as to uniformly electrify the surface of photosensitive member 51. As the surface of photosensitive member 51 uniformly charged by charger 52 reaches the exposure aperture, the photosensitive member is exposed to the light, reflected from the original, directed by optical system 40 and passing through exposure light path 53, so that the uniformly distributed charge on the surface of photosensitive member 51 is discharged whereby a static latent image corresponding to the original image is formed. As the surface of photosensitive member 51 with a static latent image thus formed moves to the station opposing developing means 54, the developer having a polarity opposite to that of the static latent image is supplied from developing means 54 so that the developer adheres to the static latent image by electrostatic force, thus forming a visualized, developer image.

As the surface of photosensitive member 51 with a developer image thereon reaches the station opposing transfer device 55, the charge having a like polarity as that of the conductive surface of photosensitive member 51 is supplied to the sheet conveyed from the sheet feeding unit 100 to photosensitive member 51. The potential of the sheet in close contact with photosensitive member 51 becomes higher than surface potential of photosensitive member 51. Therefore, the developer image on the surface of photosensitive member 51 is attracted to the sheet so that the developer image is transferred from the surface of photosensitive member 51 surface to the sheet. Separation charger 56 disposed next to transfer device 55 supplies the sheet with charge of an opposite polarity to that supplied from transfer device 55 so that the attraction between photosensitive member 51 surface and the sheet becomes weakened, whereby the sheet carrying the developer image is separated from the surface of photosensitive member 51.

When the surface of photosensitive member 51 further moves and reaches the station opposing cleaner 57, the leftover developer which has not transferred to the sheet during transfer and remains on the surface of photosensitive member 51 is removed from the surface of photosensitive member 51. When the surface of photosensitive member 51 free from the leftover developer reaches the station opposing charge erasing lamp 58, charge erasing lamp 58 radiates charge erasing light onto the photosensitive member 51 so as to lower the surface potential of photosensitive member 51 to a substantially uniform, low level. This charge erasing is performed to prevent the surface potential of photosensitive member 51 from becoming too high or uneven when the photosensitive member 51 is next charged by charger 52. The above steps are sequentially preformed so that the scanned original image is reproduced as a developer image on the sheet. Here, the developer collected by cleaner 57 is conveyed through an unillustrated developer collection conveying passage to a developer collecting container 148.

Next, referring to FIG. 5, the description will be made of sheet feeding unit 100 for feeding sheets to the transfer station in the image forming unit 50. Sheet feeding unit 100 provided in the interior lower side of copier body 1 comprises a first sheet feeder 110, a second sheet feeder 120, a third sheet feeder 130, a duplex printing feeder 140 and manual feeder 150. Each sheet feeder includes: a sheet stacking means 111, 121, 131, 141, 151; and a sheet delivering unit 114, 124, 134, 144, 154 of a sheet pickup feeding means 112, 122, 132, 142, 152 and a separation feeding means 113, 123, 133, 143, 153.

The sheet conveying path for guiding sheets, one by one, from each of sheet feeders 110, 120, 130, 140 and 150 to photosensitive member 51, is provided appropriately with conveying rollers, between a synchronization registering means 160 located immediately before photosensitive member 51 and each of sheet feeders 110, 120, 130, 140 and 150.

A sheet delivered from sheet feeder 110, 120, 130 and 150, is conveyed to synchronization registering means 160 by the conveying rollers disposed along the conveying path thereto. At the synchronization registering means 160, where the leading edge of the sheet is aligned with the axial direction of photosensitive member 51 and the sheet is delivered out toward photosensitive member 51 at a timing synchronized with the position of the developer image formed on the surface of photosensitive member 51.

The sheet bearing the developer image at transfer device 55 is separated from the photosensitive member by separation charger 56, and then is conveyed by a conveyer belt 85 to fixing unit 60.

Fixing unit 60 is mainly comprised of: a heat roller 61 made up of a metal pipe of aluminum or the like, coated with a heat resisting resin having a good separation performance; a pressure roller 62 made up of a metallic core covered with a heat resisting elastic layer such as silicone rubber; a heater lamp 63 disposed as a heat source inside heat roller 61 for heating; a temperature sensor 64 such as a thermistor and the like, disposed in contact with the peripheral surface of heat roller 61 for maintaining heater lamp 63 at the predetermined temperature; separation claws 65 disposed in contact with the peripheral surface of heat roller 61 or pressure roller 62 for separating the sheet from heat roller 61 or pressure roller 62; and a pressurizing means (not shown) for pressing heat roller 61 and pressure roller 62 to each other. The sheet carrying an unfixed developer image formed by the above image forming unit 50, but not yet fixed, is conveyed by conveyer belt 85 to reach fixing unit 60. As the sheet passes through heat roller 61 and pressure roller 62, the sheet is heated and pressed so that the developer image not yet fixed is fixed to the sheet. Thereafter, the sheet is separated from heat roller 61 or pressure roller 62 by means of separation claws 65 and is discharged from fixing unit 60.

The sheet discharged from fixing unit 60 passes through conveying rollers 86, and then is either discharged or conveyed further. That is, depending upon the path selection of a switching gate 87, the sheet is either discharged by discharging rollers 88 to the exterior of copier body 1 or conveyed to a switch-back conveying path 91 by means of conveying rollers 89 and normal/reversal rollers 90. The sheet fed into switch-back conveying path 91 is guided by the path selection of a switching gate 92 and the reversal rotation of normal/reversal rollers 90 toward duplex printing feeder 140. The sheets delivered out from switch-back conveying path 91 and having passed through feed rollers 93, are successively stacked onto duplex printing feeder 140. The sheets temporarily stacked on duplex printing feeder 140 are separated and fed, one by one, by the function of sheet pickup feeding means 142 and separation feeding means 143. The sheets stacked on duplex printing feeder 140 are fed again toward the photosensitive member so that the unprinted side faces photosensitive member 51.

When the one-sided printing mode is selected through an unillustrated control panel, the sheet delivered from sheet stacking means 111, 121, 131 or 151, is formed with an image on its one side, and after its fixing, the sheet is discharged from copier body 1 to the machine exterior. On the contrary, when the duplex printing mode is selected, the sheet delivered from sheet stacking means 111, 121, 131 or 151, is formed with an image on its one side, and after its fixing, the sheet is stacked onto duplex printing feeder 140, and then the sheet is fed again toward the photosensitive member so that another image is formed on the opposite, unprinted side, thereafter, the sheet is discharged from copier body 1 to the machine exterior, in the same manner as in the one-sided printing mode.

The sheet thus discharged from copier body 1 is then conveyed into post-processing unit 70 shown in FIG. 3. Post-processing unit 70 is mainly composed of a staple tray 74, a stapler 75, a pusher 76, a bound sheet discharge tray 77, a stack tray 80 and the like. The sheet discharged from copier body 1 is sent to entrance rollers 71, and then is either delivered via conveying rollers 73 to be stacked on staple tray 74, or conveyed by convening rollers 78 and discharging rollers 79 to be stacked onto stack tray 80, depending upon the path selection of a switching gate 72. Sheets stacked on staple tray 74 are bound by stapler 75 every predetermined number of copies, then the bound sheets are discharged to bound sheet discharge tray 77 by pusher 76.

The description of the configuration and overall operation of the copier has been completed.

For making the copier compact, the correlation between the devices laid out inside the copier is important, so this will be described next.

Copier body 1 as already described, incorporates a variety of devices having diverse functions. These devices are, for example, optical system 40, image forming unit 50, sheet feeding unit 100 and the like, and are provided as functional units each having a single function or a plurality of functions. In practice, like image forming means 50, for example, which includes developing means 54, developer collecting container 148, charger 52, cleaner 57 or like sheet feeder 110, 120, 130, 140, 150 which includes sheet stacking means 111, 121, 131, 141, 151 and sheet delivering unit 114, 124, 134, 144, 154 and the like, each functional unit may be divided into sub-units therein. This divided configuration into sub-units, provides easiness for replacement of broken parts and/or supply parts and for releasing jams, and facilitates assembly and disassembly.

In general, miniaturization of an apparatus handling the sheets such as a copier is markedly affected by the size of sheet and the type of the sheet material because the handling target is a sheet. For example, as regards the direction of conveying the sheet, it is necessary to consider the stacking performance of sheets (a certain flatness is needed for placement in order to avoid the stacked sheet being skewed etc.) and the conveying performance of sheets (the conveying performance is affected by the sheet path shape such as the smallest radius of curvature in the sheet path, depending upon the stiffness of the sheet), so that miniaturization of the apparatus can be attained only to an extent in which the above conditions are satisfied. Further, as regards the direction perpendicular to the sheet conveying direction, stacking performance of the sheets, conveying performance of sheets, the efficiency of image formation, the quality of formed images need to be considered. Therefore, devices such as the sheet feeder and the image forming unit for forming images onto sheets, will occupy substantially the whole area facing the sheet, across a direction perpendicular to the sheet conveying direction. Further, the functional units are often attached and detached in the direction perpendicular to the sheet conveying direction. Accordingly, if functional units or part of functional units need to be laid out in the space or path of a certain functional unit in this direction, multiple functional units must be moved for attachment and detachment of the functional unit, degrading ease of attachment and detachment.

However, concerning the direction of the sheet thickness, the thickness with which the sheets can be accommodated and the dimensions of the device relating to the sheets are the factors limiting the miniaturization. Of these factors, the factor which can be dealt with by design is the dimension in the direction of the sheet thickness of a device relating to the sheets. So, each of the above-referred functional units needs to be made thinner. For this purpose, it is necessary to miniaturize the parts in each functional unit and it is also necessary to enhance the flexibility of layout of the parts excepting those which cannot be modified as to the positions and are required to be positioned at the particular sites in the functional unit from design requirements.

Next, an embodiment of the invention for making the functional units in a copier thin and compact and hence miniaturizing the copier itself, will be described in detail with an example of a sheet feeder.

Referring now to FIGS. 3, 5 through 16, detailed description will be made of a manual feeder 150 as a type of sheet feeders and a developer collecting container 148 to which an embodiment of the invention is applied.

As shown in FIGS. 3 and 5, manual feeder 150 is disposed on the right side of copier body 1 while developer collecting container 148 is laid out thereabove. Next to developer collecting container 148 is a developing means 54.

Manual feeder 150 and developer collecting container 148 will be described first and then the mutual relationship, in the arrangement of the invention, between manual feeder 150 and developer collecting container 148 in their attached state will be explained next.

Figure 6:
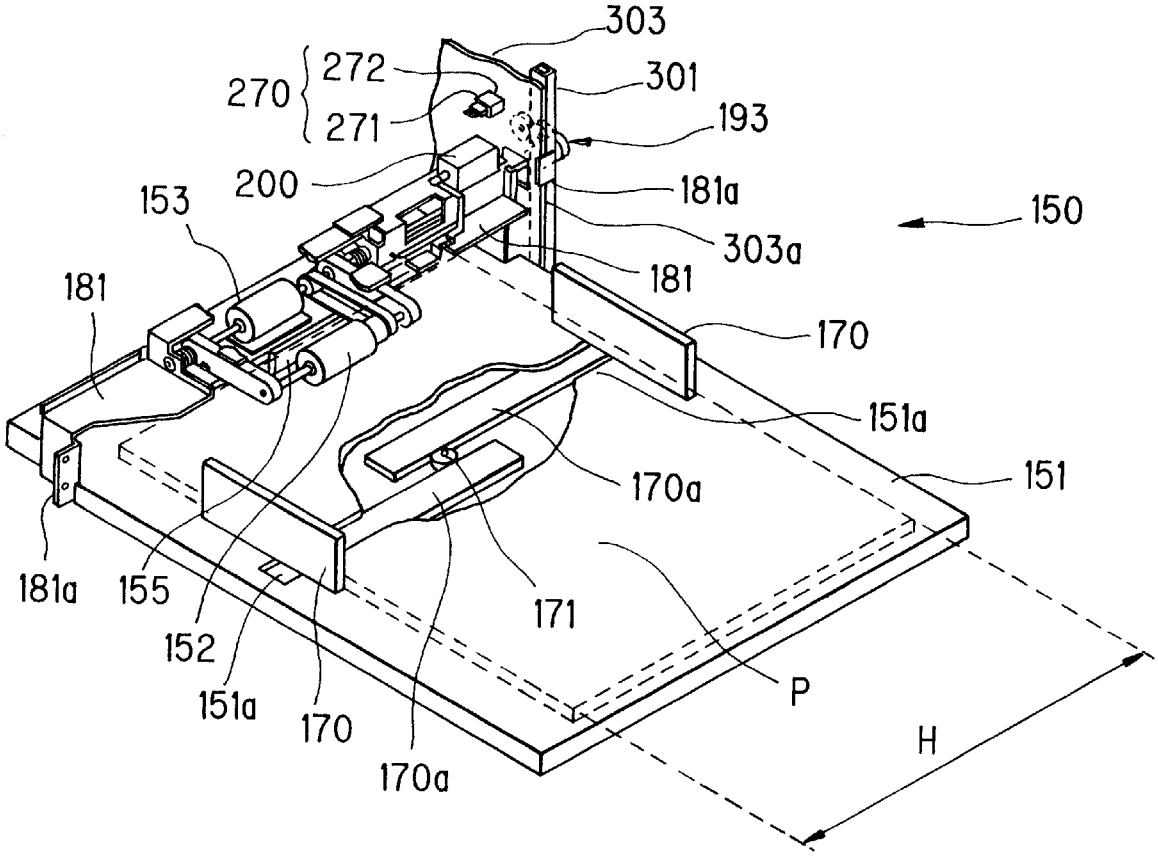
FIG. 6 is an overall perspective view showing a manual sheet feeder.
Figure 7:
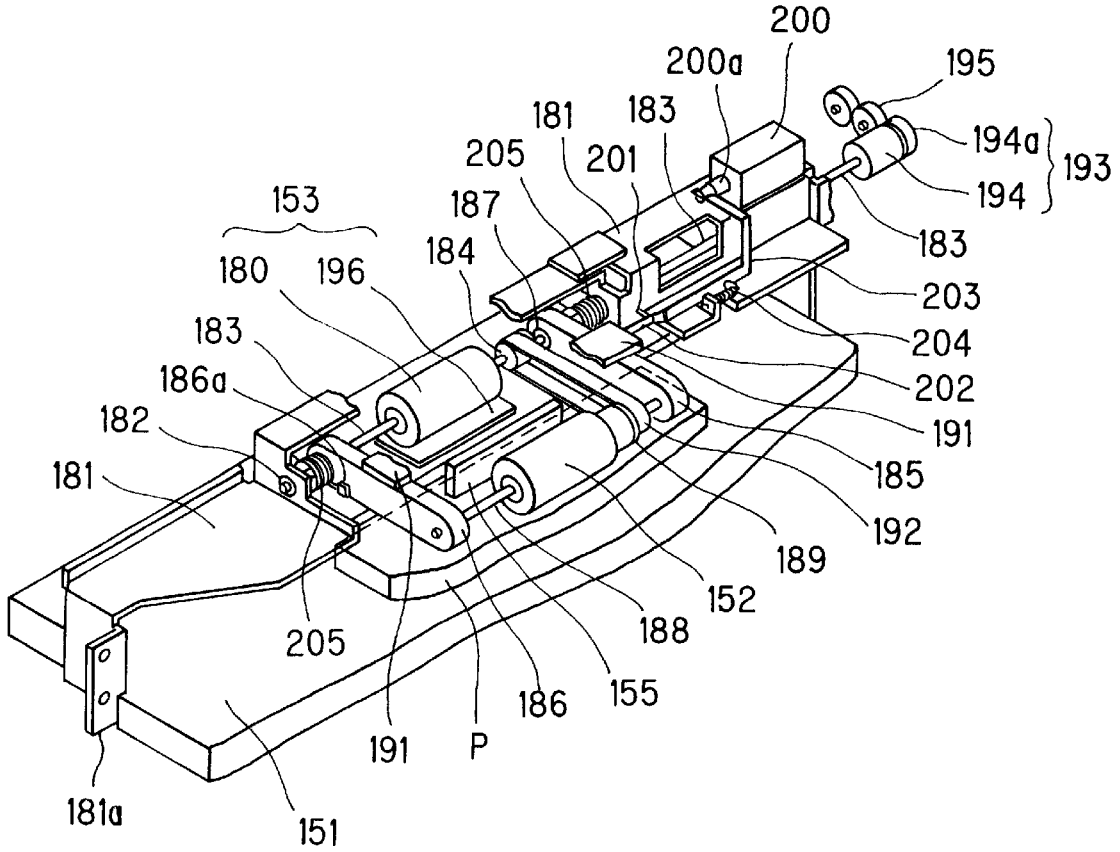
FIG. 7 is an enlarged perspective view showing essential parts of a manual sheet feeder.

Referring first to FIGS. 6 and 7, manual feeder 150 will be explained in detail. FIG. 6 is an overall perspective view of manual feeder 150 and FIG. 7 is a partial enlarged perspective view showing elements thereof.

As shown in FIG. 6, manual feeder 150 comprises: a sheet stacking means 151 for stacking a sheet, a pickup feeding means 152 for feeding a sheet P placed on sheet stacking means 151 downstream with respect to the feeding direction of manual feeder 150, a separation feeding means 153 and a sheet stopper 155.

Now a description of sheet stacking means 151 will be made. There are width constraining plates 170 in the central portion of sheet stacking means 151. These width constraining plates 170 constrain sheets at both side-edges with respect to the direction perpendicular to the feeding direction of the sheets placed on sheet stacking means 151. A rack portion 170*a* is provided under the sheet stacking means 151 and integrally formed via an opening 151*a* with each width constraining plate 170 and is meshed with a pinion gear 171 which is rotatably disposed on the underside of sheet stacking means 151. These constraining plates are configured so that when one of width constraining plates 170 is moved, the other width constraining plate 170 will move, mutually approaching each other or mutually moving away from each other. By this mechanism, the center of the sheets will not vary with the sheet size, even if the sheets to be constrained by width constraining plates 170 varies in size. Here, sheet stacking means 151 is fixed to a sheet feeder frame 181.

Components designated at 181*a*, 193, 200, 270, 271, 272, 301 and 303 will be described later.

Figure 8A:
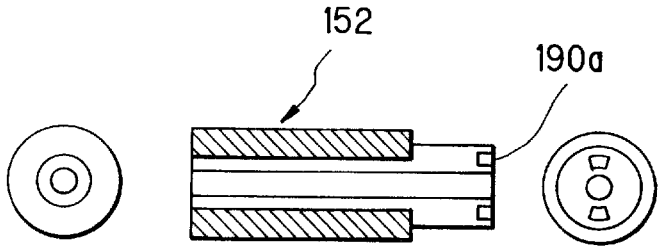
FIG. 8A is a sectional view showing a pickup feeding means.
Figure 8B:
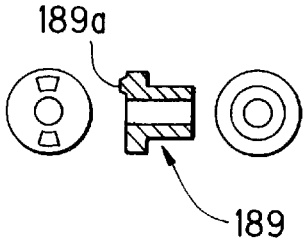
FIG. 8B is a sectional view showing a pulley B.
Figure 9:
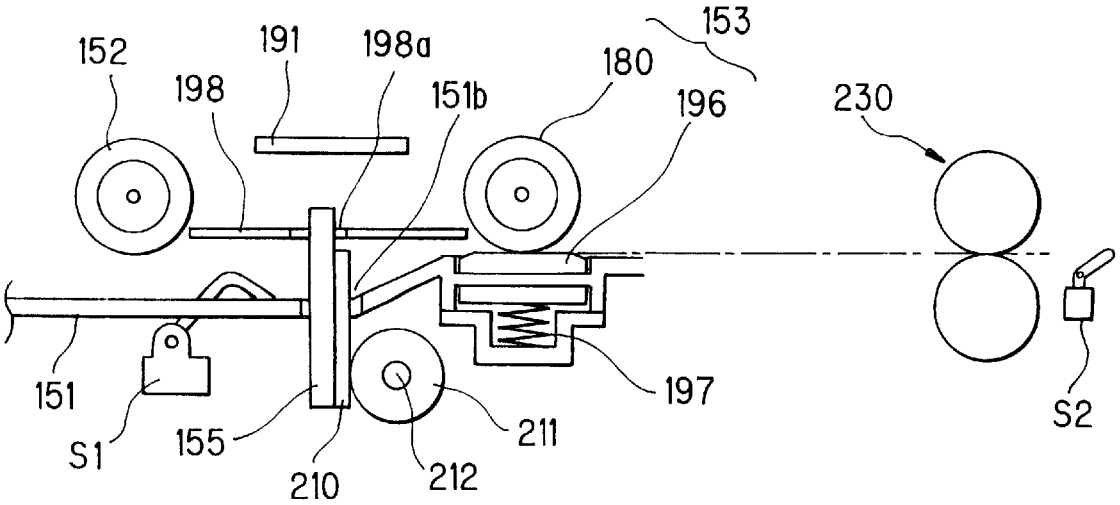
FIG. 9 is a sectional view showing essential parts of a manual sheet feeder.

Referring next to FIGS. 7 through 9, description will be made of pickup feeding means 152, separation feeding means 153 and driving means for these, all disposed downstream of sheet stacking means 151, with respect to the sheet conveying direction. FIG. 8A is a sectional view showing pickup feeding means 152, and FIG. 8B is a sectional view of a pulley. FIG. 9 is a sectional view showing essential elements of the manual feeder.

As shown in FIG. 7, a drive input shaft 183 is supported rotatably via bearings 182 by feeder frame 181 and has a feed roller 180 (one part of separation feeding means 153) and a pulley 184 fixed thereon. Further, support arms 185 and 186 are rotatably supported by the drive input shaft at their one end via bearings 187 and restricted by E-rings (not shown) or the like so that these arms will not move in the thrust direction of drive input shaft 183.

A rotary support shaft 188 is fixed to support arms 185 and 186 at their other end. With holes 190*a* (see FIG. 8A) on the end face of pickup feeding means 152 mated with a projection 189*a* (see FIG. 8B) on the end face of a pulley 189, pickup feeding means 152 and pulley 189 are integrally supported so as to be rotatable by means of rotary support shaft 188. Pickup feeding means 152 and pulley 189 are positioned and restricted by E-rings (not shown) or the like so that these elements will not move in the thrust direction of rotary support shaft 188. Support arms 185 and 186 are coupled with each other by a coupling plate 191 while a belt 192 is wound between a pulleys 184 and 189.

Provided at one end of drive input shaft 183 is a drive coupler 193 from the machine body side to manual feeder 150 (see FIG. 6). Drive coupler 193 is composed of a feeder clutch 194 having an input gear 194*a*. Driving force from an unillustrated motor disposed on the copier body side is transmitted from a gear 195 rotatably supported by a rear frame 303 (see FIG. 6) on the copier body side to input gear 194*a*, and then transmitted to drive input shaft 183 and feed roller 180, in this order, to rotate feed roller 180. The drive force thus transmitted to drive input shaft 183 is further transferred to pickup feeding means 152 through pulley 184, belt 192 and pulley 189 in this order, so as to rotate pickup feeding means 152.

As shown in FIGS. 7 and 9, a separation pad 196 is disposed in the sheet stacking means 151 on the side facing feed roller 180, and is urged by an elastic element 197 such as a compression spring etc., so as to be abutted against feed roller 180. Provided fixedly to support arms 185 and 186 between feed roller 180 and pickup feeding means 152, is a sheet guide 198. Separation feeding means 153 is configured of feed roller 180 and separation pad 196. Disposed downstream of separation feeding means 153 with respect to the feeding direction is a conveying means 230. A sheet detecting sensor S2 is arranged directly downstream of conveying means 230.

Here, reference numeral 155 designates a sheet stopper, and S1 designates a sheet set sensor for detecting the sheets set on sheet stacking means 151. Components designated by reference numerals 151*b*, 198*a*, 210 and 211 in FIG. 9 will be described later.

Figure 10A:
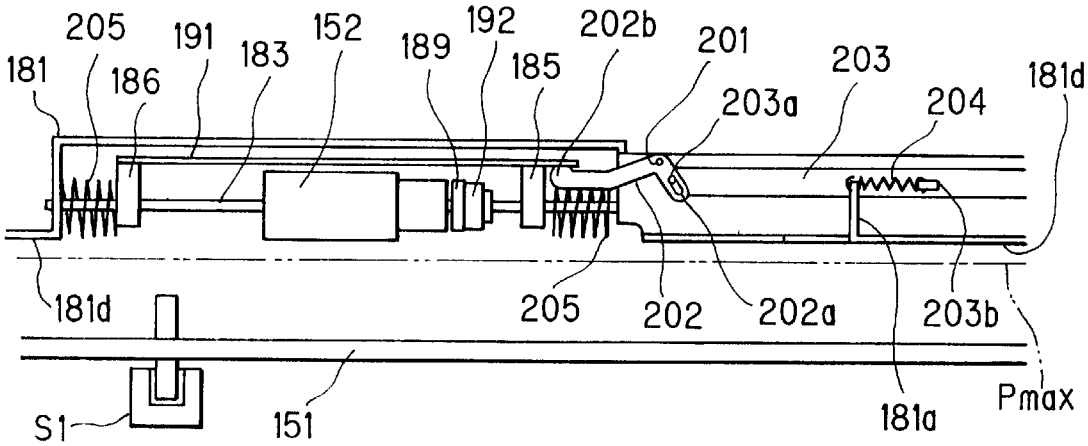
FIGS. 10A and 10B are illustrative views showing the operation of a mechanism for shifting up and down a pickup feeding means.
Figure 10B:
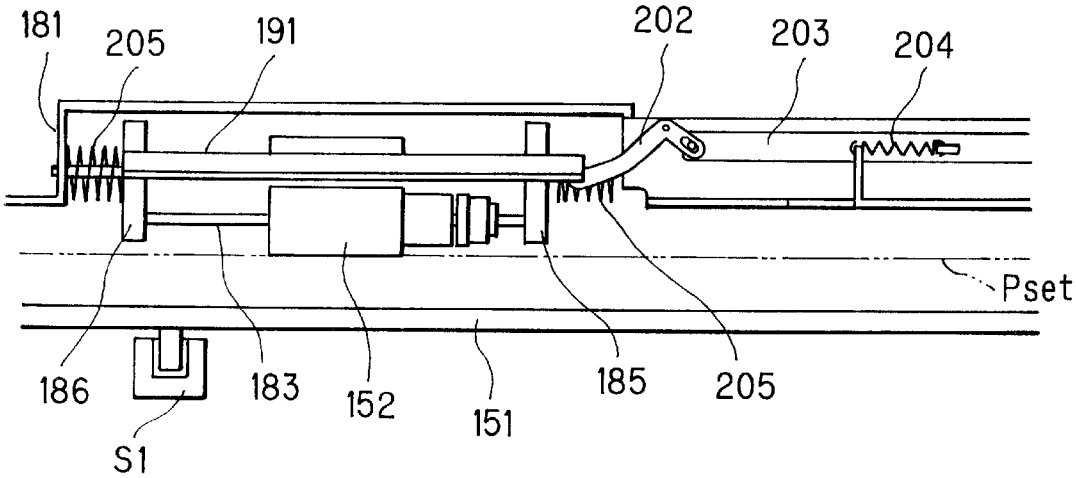

Referring next to FIGS. 7 and 10A and 10B, the mechanism for shifting pickup feeding means 152 up and down will be described. FIGS. 10A and 10B are illustrative views showing the operation of the mechanism for shifting pickup feeding means 152 up and down.

A lever support shaft 201 disposed in feeder frame 181 has a lever 202 rotatably supported thereon. A pickup solenoid 200 as the drive source is fixedly arranged at one end of feeder frame 181. A lever 203 is provided between solenoid 200 and lever 202, with its hole at one end thereof receiving a pin from a plunger 200*a* of pickup solenoid 200 and a projection 203*a* at the other end thereof fitted into a slot 202*a* of lever 202. A return spring 204 is engaged between a projection 203*b* provided in the mid portion of lever 203 and a cut and bent portion 181*a* of feeder frame 181.

Further, a feeder pressing spring 205 of a coil type is fitted on drive input shaft 183 on the outer side of support arm 186. One end of feeder pressing spring 205 is engaged with an engaging portion 186*a* of support arm 186 while the other end of feeder pressing spring 205 is engaged with the rear side of feeder frame 181 so as to urge support arm 186 toward sheet stacking means 151. Similarly, another feeder pressing spring 205 is provided on the outer side of support arm 185, in the same manner as in the case of support arm 186. Thus, pickup feeding means 152 is urged toward sheet stacking means 151 by the action of the two feeder pressing springs 205.

In the above arrangement, when pickup solenoid 200 is turned off, the elastic force from return spring 204 acts on lever 203 in the longitudinal direction thereof so as to move the lever 203 to the left in FIG. 10A. This causes lever 202 to rotate clockwise about lever support shaft 201 and hence press the rear side of coupling plate 191. By this pressing, pickup feeding means 152 rotates about drive input shaft 183, opposing the urging force of feeder pressing spring 205 and gravity acting on the portion integrally rotating with pickup feeding means 152 such as support arms 185 and 186, etc., thus moving upwards and hence separating from the sheets set on sheet stacking means 151. In this case, in order to limit lever 203 so that it does not move leftward, in the drawing, beyond a predetermined extent, an unillustrated stopper for stopping lever 203 is provided. In this situation, pickup feeding means 152 is located above the maximum sheet set height Pmax. The distance between the maximum sheet set height Pmax and the level of a sheet guide surface (the bent portion of frame 181 opposing the sheets) 181*d* integrally formed with feeder frame 181 is set appropriately so as not to make it difficult to supply sheets into sheet stacking means 151.

Reference numerals, S1, 189 and 192 designate a sheet set sensor, a pulley and a belt, respectively.

When pickup solenoid 200 is activated, lever 203 moves to the right as shown in FIG. 10B, opposing the urging force of return spring 204. This causes lever 202 to rotate counterclockwise about lever support shaft 201 so as to press an abutting portion 202*b* of lever 202 down. Resultantly, pickup feeding means 152 is lowered to the level of the height Pset of the sheets placed on sheet stacking means 151, by the urging force of feeder pressing spring 205 and due to gravity acting on the portion integrally rotating with pickup feeding means 152, thus abutting the sheets. Here, S1 designates a sheet set sensor.

Figure 11:
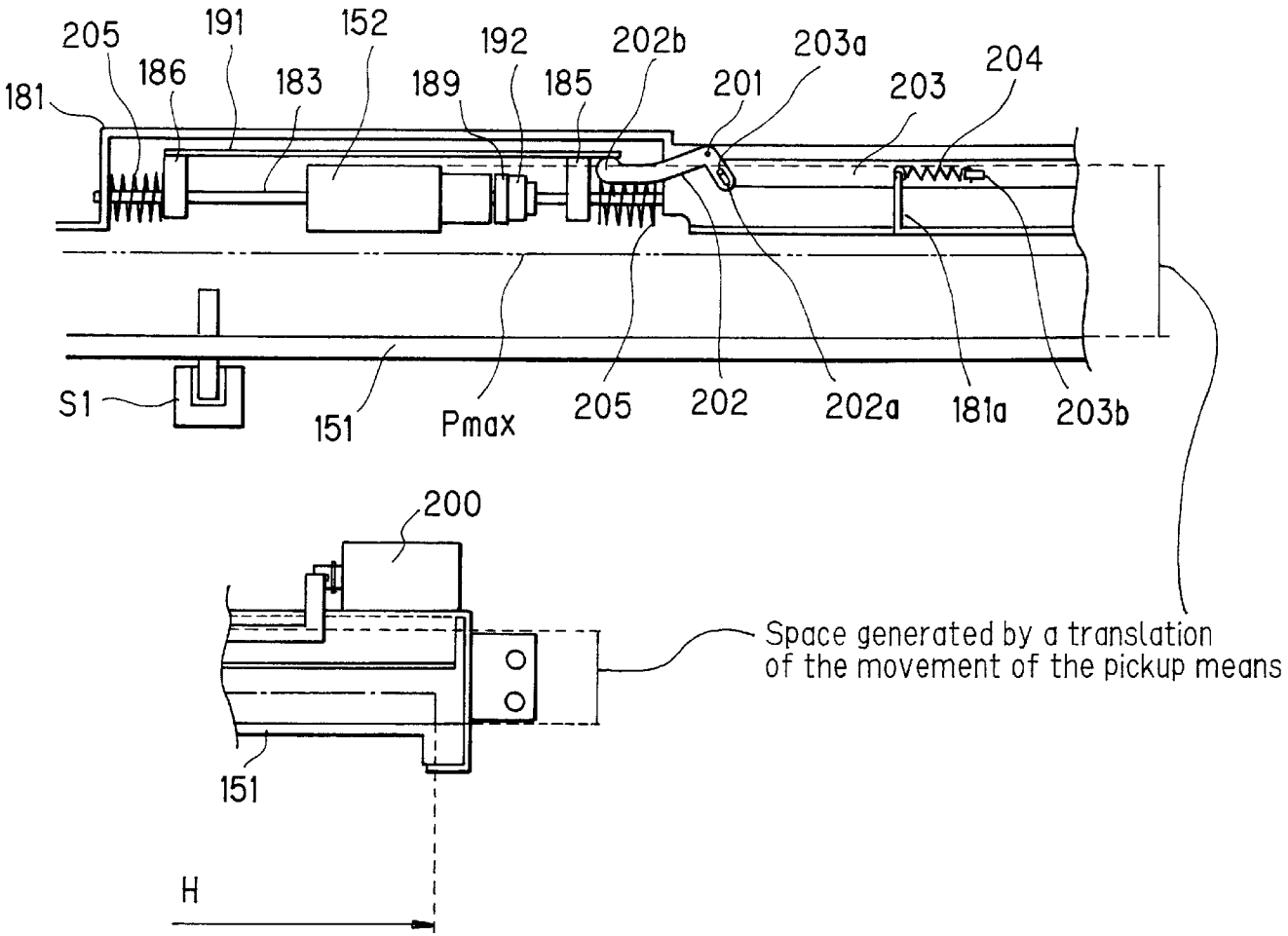
FIG. 11 is a sectional view showing a mechanism for shifting up and down a pickup feeding means.
Figure 12:
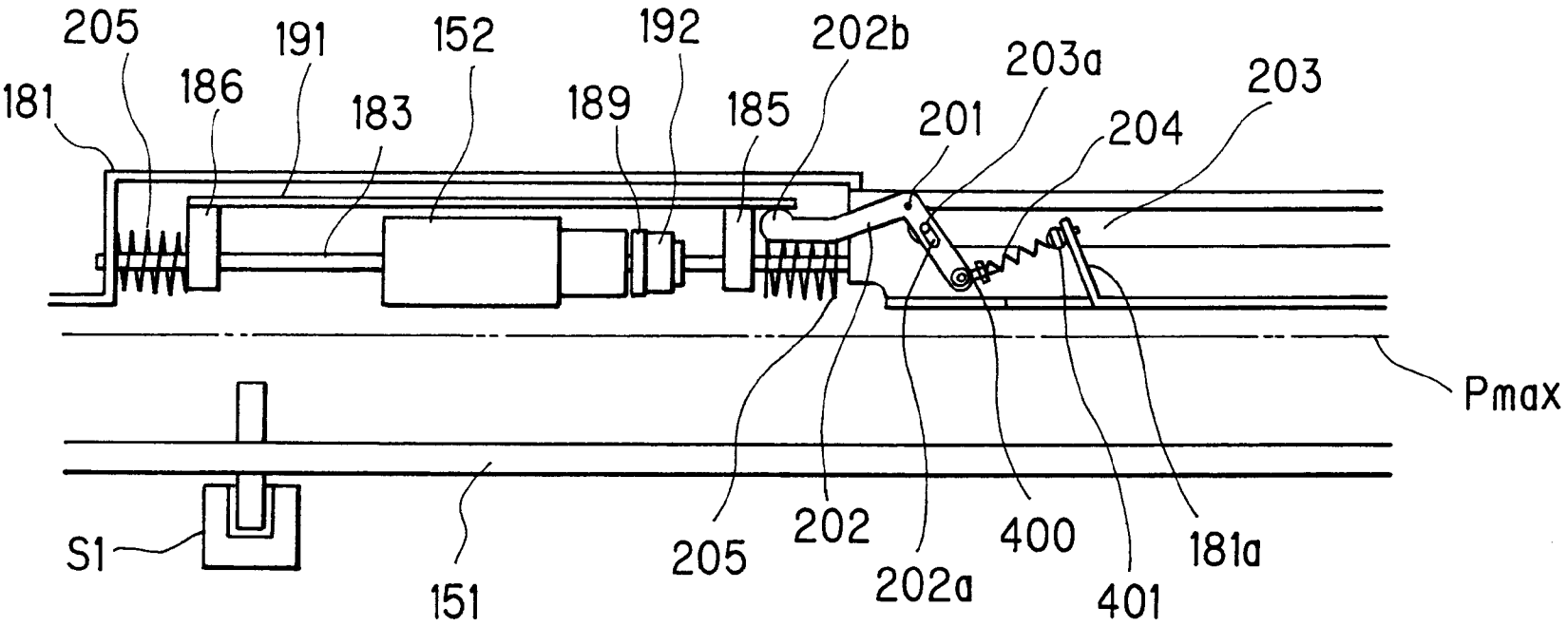
FIG. 12 is a sectional view showing another mechanism for shifting up and down a pickup feeding means.

As shown in FIG. 11, lever 203 as the shifting means for shifting pickup feeding means 152 between the active position and inactive position, resides within a space by translating a mid area across the full width of the acceptable maximum size sheet, in the direction of the sheet thickness. That is, the space required for pickup feeding means 152 to move between the active position and the inactive position is arranged so as to be in contact with two planes perpendicular to the direction of the sheet thickness, and lever 203 moves within the range between the two planes. This lever 203 extends to a space defined by translating a boundary area of the full width of the acceptable maximum size sheet, in the direction of the sheet thickness, and is coupled therein with pickup solenoid 200 as the drive source of shifting pickup feeding means 152. As will be described in another embodiment hereinbelow, this lever 203 may extend to a space defined by translating an area beyond the full width of the acceptable maximum size sheet, in the direction of the sheet thickness.

In this other embodiment, lever 203 is extended, in the direction perpendicular to the sheet conveying direction, to a space defined by translating a boundary area of the full width of the acceptable maximum size sheet in the direction of the sheet thickness, or is extended, in the direction perpendicular to the sheet conveying direction, to a space defined by translating an area beyond the full width of the acceptable maximum size sheet in the direction of the sheet thickness. This configuration creates open space around the maximum size sheet except on the leading side of the maximum size sheet in the sheet conveying direction. If the sheet stacking means is arranged outside the image information processing apparatus, a large open space can be ensured above the sheets, whereby sheets can be easy to be set onto the sheet stacking means. If the sheet stacking means of the sheet feeder is laid out within the image information processing apparatus, the open space can be used for allotting other parts and/or adjacent functional units, thus promoting the miniaturization of the image information processing apparatus.

The lever 203 may be disposed in another way. If that other parts and/or functional units need to be laid out, in the direction perpendicular to the sheet feeding direction, within a space defined by translating a boundary area of the full width of the maximum size sheet, in the direction of the sheet thickness, or if the other parts and/or functional units need to be laid out, in the direction perpendicular to the sheet feeding direction, within a space defined by translating an area beyond the full width of the maximum size sheet, in the direction of the sheet thickness. In such a case, lever 203 is arranged in an inclined manner so that the lever may be extended in a direction perpendicular to the sheet feeding direction to a space (other than the above space) defined by translating a boundary area of the full width of the maximum size sheet, in the direction of the sheet thickness, or the lever 203 may be extended in a direction perpendicular to the sheet feeding direction to a space (other than the above space) defined by transplanting an area beyond the full width of the maximum size sheet, in the direction of the sheet thickness.

Since this lever 203 is adapted to transmit the driving force by movement in the longitudinal direction, this configuration does not need large space for the moving path of lever 203 when the functional part relating to sheet feeding is moved between the active and inactive positions, thus contributing the miniaturization of manual feeder 150.

Reference numerals 151, 181, 181*a*, 183, 185, 186, 189, 191, 192, 201, 202, 202*a*, 202*b*, 203*a*, 203*b*, 205 and S1 designate the same components shown in FIG. 10.

Although it was illustrated that return spring 204 is hooked to lever 203, a return spring (a compression spring) 204 may be engaged between a spring engaging part 400 which is pivotally supported at the end of the part having a slot 202*a* of lever 202 and a spring support part 401 fixed to a bent portion 181*a* from feeder frame 181, so as to permit the elastic force of return spring 204 to act on lever 202, to thereby move pickup feeding means 152 from the active position to the inactive position. In this case, return spring 204 is engaged with the spherical part of spring support part 401, and both ends of return spring 204 will not bend when lever 202 moves, so that it is possible to avoid buckling.

Further, lever 203 of this embodiment is bent in the direction perpendicular to its direction of movement, but as will be described with reference to another example (see FIGS. 22A and 22B), the lever can be formed without bending, depending upon the situation of the layout of the drive source.

Reference numerals 151, 183, 185, 186, 189, 191, 192, 201, 202*b*, 203*a*, 205 and S1 designate the same components shown in FIG. 10.

Next, referring to FIGS. 9 and 13, the drive mechanism of a sheet stopper will be described. First, as shown in FIG. 9, a sheet stopper 155 is disposed on the side of sheet stacking means 151 between pickup feeding means 152 and feed roller 180. This layout of the stopper is to prevent the sheets set on sheet stacking means 151 from excessively moving up toward separation feeding means 153, and to register the sheet set on sheet stacking means 151 in cooperation with width constraining plates 170. Racks 210 are integrally provided on the side, of sheet stopper 155, opposite to the side where sheets are set. These racks 210 mesh with corresponding pinions 211. As pinions 211 are driven, sheet stopper 155 moves up and down. That is, sheet stopper 155, can move down, through an opening 151*b* formed in manual feeder table 151, into the plugged position in manual feeder table 151 and goes up, through manual feeder table 151 and through and above an opening 198*a* formed in sheet guide 198, to a position where the stopper can block the sheets. Disposed between sheet stopper 155 and pickup feeding means 152 is a sheet set sensor S1 for detecting the sheets set on sheet stacking means 151.

Figure 13:
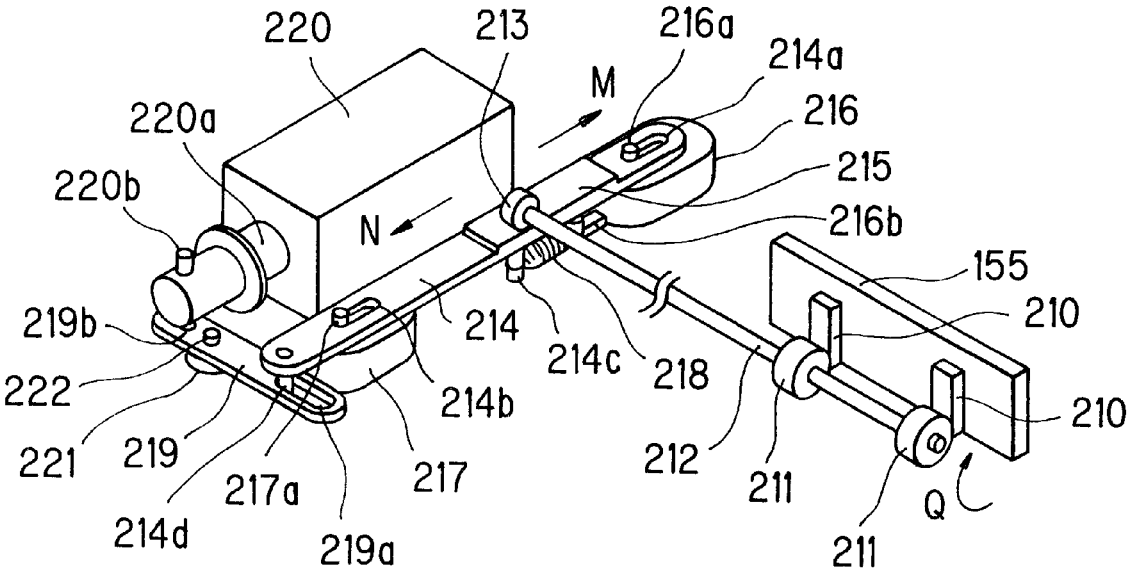
FIG. 13 is a perspective view showing a drive mechanism of a sheet stopper.

Referring to FIG. 13, the drive mechanism of this sheet stopper 155 will be described in further detail. FIG. 13 is a perspective view showing a drive mechanism of sheet stopper 155.

Arranged on the underside of sheet stacking means 151 is a drive mechanism of a sheet stopper 155, as shown in FIG. 13. As has been already described, racks 210 provided in sheet stopper 155 mesh pinions 211. A rotary shaft 212 having pinions 211 fixed thereon has another pinion 213 at the end thereof. Pinion 213 is engaged with a rack 215 which is integrally formed with a lever 214. Sheet stacking means 151 has a pair of slide supports 216 and 217 integrally attached thereto, each having a pin 216*a* and 217*a*. A pair of slots 214*a* and 214*b* provided in lever 214 and fit on pins 216*a* and 217*a*, respectively. Lever 214, can be slid over slide supports 216 and 217 within the distance limited by slots 214*a* and 214*b* and pins 216*a* and 217*a*.

Return spring 218 is hooked between an engaging portion 216*b* provided in slide support 216 and an engaging portion 214*c* provided in lever 214, so as to urge lever 214 in the direction of arrow M in the figure. Lever 214 has a pin 214*d* on its rear side at the end near slide support 217. This pin 214*d* is inserted into a slot 219*a* of a lever 219 which is rotatable about a pivot 222 provided on pivot support 221. Formed at the other end of lever 219 opposite slot 219*a* is a slot 219*b*, into which a pin 220*b* provided for a plunger 220*a* of a stopper solenoid 220 is fitted. Here, unillustrated E-rings or other stoppers are provided so as to avoid lever 214 slipping off from pins 216*a* and 217*b*, and lever 219 from pivot 222.

Because of the configuration described above, when stopper solenoid 220 is off (the state shown in FIG. 10A), lever 214 moves in the M direction from the elastic force of return spring 218 so as to raise sheet stopper 155 to the sheet blocking position. When stopper solenoid 220 is activated, plunger 220*a* is pulled in opposing the elastic force of return spring 218, so that lever 214 moves in the N direction and hence pinions 211 rotate in the Q direction, to thereby move down sheet stopper 155 to the sunken position inside manual feeder table 151.

Similarly to the above case described concerning the arrangement of the drive transmitting assembly of pickup feeding means 152, the space required for sheet stopper 155 to move between the active position and the inactive position is arranged so as to be in contact with two planes perpendicular to the direction of the sheet thickness, and the drive transmitting assembly for sheet stopper 155, including racks 210, pinions 211, rotary shaft 212, lever 214 and lever 219, is arranged within this space. Further, stopper solenoid 220 as the drive source and return spring 218 are also arranged in the same space.

In this case, differing from the case of the drive transmitting mechanism of pickup feeding means 152, racks 210 as parallel movement type drive transmission means, are provided integrally with sheet stopper 155, on the side opposite the sheet blocking side. Further, pinions as rotary type drive transmission means 211 are used to transfer the driving force to these racks 210. Rotary shaft 212 for pinions 211 extends to a space defined by translating a boundary area of the full width of the maximum size sheet, in the direction of the sheet thickness, or rotary shaft 212 extends to a space defined by translating an area beyond the full width of the maximum size sheet in the direction of the sheet thickness. This rotary shaft is engaged with rack 215 in this area.

In this example, stopper solenoid 220 is coupled with lever 214 having a rack 215 via lever 219, so that the movement of plunger 220*a* of stopper solenoid 220 is enhanced by the principle of leverage, i.e., by lever 219, and is transferred to lever 214. If the attraction of stopper solenoid 220 is strong enough and the stroke of the plunger 220*a* can be secured large enough, lever 214 may be directly moved by stopper solenoid 220.

Figure 14:
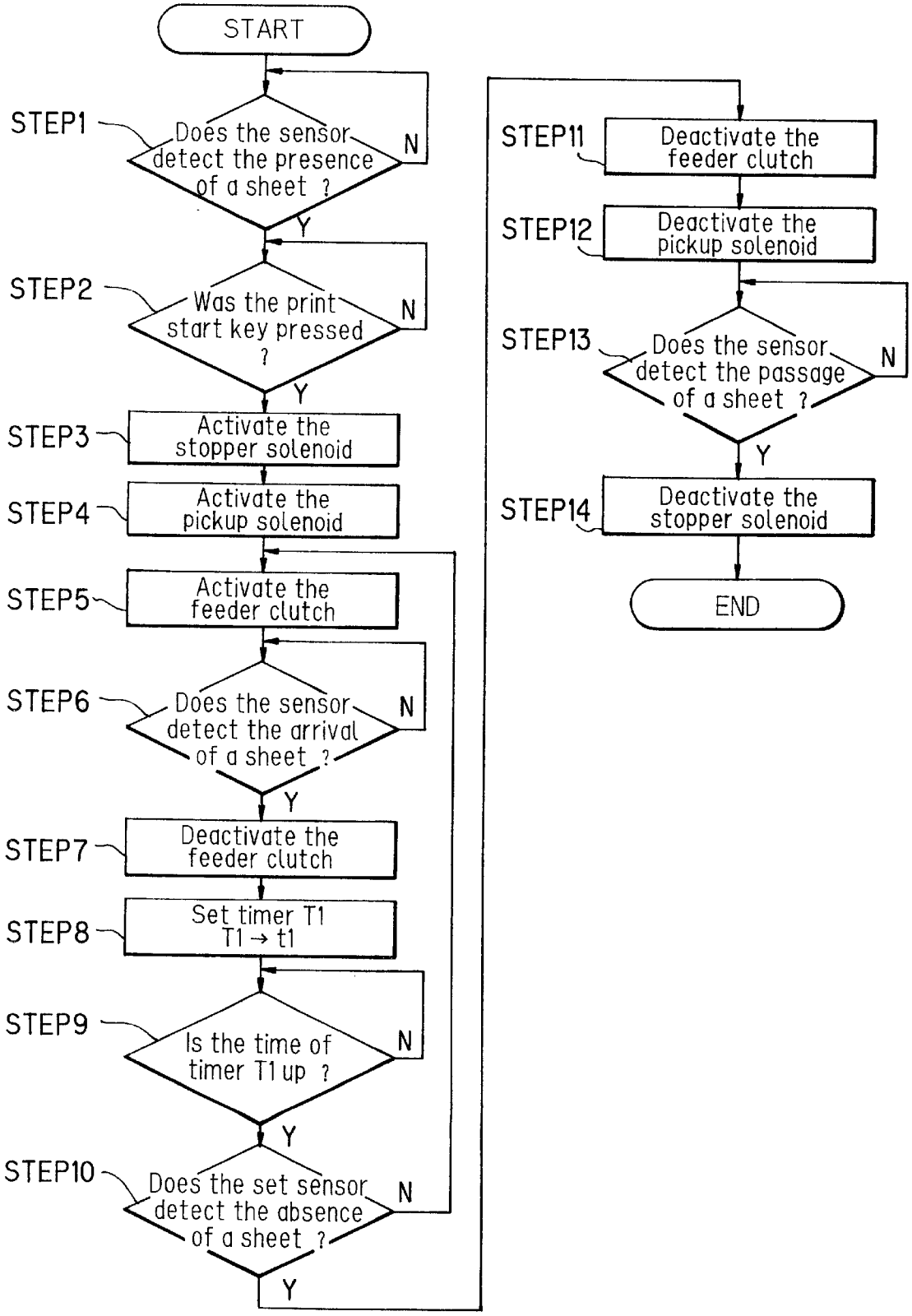
FIG. 14 is a flowchart showing the operation of an image processing apparatus during sheet feeding.

As the mechanisms have been described heretofore, the operation flow of these mechanisms upon sheet feeding will be described with reference to FIGS. 6, 7, 10A and 10B and 14. Here, FIG. 14 is a flowchart showing the operation during sheet feeding in the image processing apparatus.

When sheet set sensor S1 detects the setting of sheets on sheet stacking means 151 (Step 1), operation is waited for until the input of the print start key on the control panel (not shown) (Step 2). When the print start key is operated, stopper solenoid 220 is activated so as to move sheet stopper 155 projected from sheet stacking means 151, down therein (Step 3). Then pickup solenoid 200 is turned on so as to abut pickup feeding means 152 against the sheet (Step 4). Subsequently, feeder clutch 194 is activated so as to rotate feed roller 180 and pickup feeding means 152, whereby sheets set on sheet stacking means 151 are separated and fed, one by one (Step 5).

Operation is waited for until sheet detecting sensor S2 detects that the sheet is nipped at conveying means 230, arranged downstream directly of separation feeding roller 180 with respect to sheet feeding direction (Step 6). When sheet detecting sensor S2 detects the sheet, feeder clutch 194 is turned off (Step 7). Next, timer T1 is started (Step 8) as soon as sheet detecting sensor S2 detects the leading edge of the sheet, for the predetermined period of time (t1 in this case). The operation is waited for until the time on timer T1 is up (Step 9). When the time on timer T1 is up, it is judges whether sheet set sensor S1 has detected the non-sheet state (Step 10). If the detection result from sheet set sensor S1 shows the presence of a sheet, the operation returns to Step 5. In this case, the reason feed roller 180 and pickup feeding means 152 are stopped by turning off feeder clutch 194 until timer T1 reaches the predetermined time (t1), is to keep the feeding interval between sheets constant.

At Step 10, if the detection result of sheet set sensor S1 shows absence of any sheet, feeder clutch 194 is turned off (Step 11), and pickup solenoid 200 is turned off (Step 12). Next, the operation is waited for until sheet detecting sensor S2 detects the end of the passage of the sheet (Step 13). That is, since the timing at which the signal from the sheet detecting sensor changes from the state of sheet presence to the state of sheet absence, indicates the rear end of a sheet, the detection of the rear end of the sheet corresponds to the end of the passage of the sheet. When sheet detecting sensor S2 detects the end of the passage of the sheet, stopper solenoid 220 is deactivated (Step 14).

Figure 15:
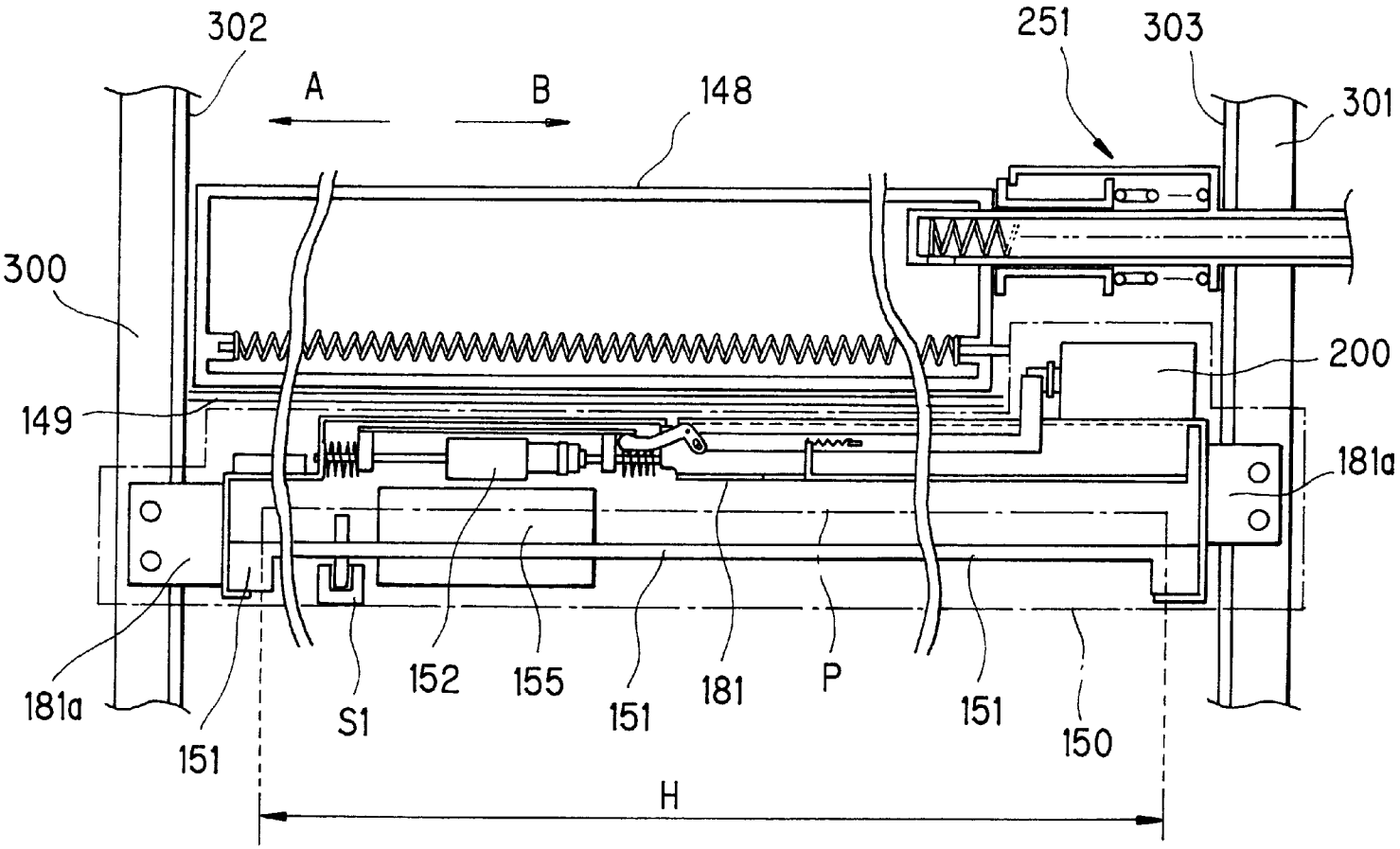
FIG. 15 is a section view of a copier body with a manual sheet feeder.

Next, the attachment for fixing manual feeder 150 to the copier body and the method of withdrawal for detaching the feeder from the copier body will be described with reference to FIGS. 6 and 15. FIG. 15 is a side view showing a manual feeder in the copier body.

As has been described, manual feeder 150 (enclosed by the chain line) is provided in a unit form which integrally holds various parts and can be attached and detached with respect to copier body 1, forming a functional unit having the function of feeding sheets which are manually set. Upon attachment of this manual feeder 150 to the copier, this feeder is attached to the predetermined position from the right side toward the left side of copier body 1 (from the front to the rear in the document in FIG. 15).

First, with manual feeder 150 kept angled with respect to the copier body, driver coupler 193 for transmitting driving force from the machine body to manual feeder 150 is fitted through an opening 303*a* of rear frame 303 into the rear of the rear-side chassis (designated at 301). Then manual feeder 150 is moved in the attaching direction until a pair of fixtures 181*a* of feeder frame 181 abut front-side and rear-side chassises 300 and 301, respectively. In this state, the manual feeder is fixed to the chassises with fixing means such as screws, etc. Then, a connector 271, on manual feeder 150 side, including the signal line of sheet set sensor S1, power lines for pickup solenoid 200 and stopper solenoid 220 (see FIG. 13) and the copier side connector 272 are joined to complete an electric coupling 270. Thus the attachment of manual feeder 150 to copier body 1 is completed.

Withdrawal of manual copier 150 is done in the reverse direction as done in the above attachment procedures.

Pickup feeding means 152 and separation feeding means 153 provided in manual feeder 150 need to directly abut the sheets to feed them. Therefore, pickup feeding means 152 is arranged in a position able to come in contact with the sheet, that is, near and above sheet stacker 151, within the acceptable maximum width H (the width in the direction perpendicular to the sheet feeding direction) of sheets to be fed. Since there are various sizes of sheets to be handled within the acceptable maximum width H, both means 152 and 153 are necessarily arranged in the mid portion of the acceptable maximum sheet width H so as to feed any size of sheets. Therefore, for the purpose of miniaturization, it is contemplated that the means other than those that are needed to come in contact with the sheets, such as pickup solenoid 200 and the like, may be arranged away from pickup feeding means 152 and separation feeding means 153.

As shown in FIG. 15, pickup solenoid 200 is arranged in the space excepting a space defined by translating the occupied areas of pickup feeding means 152 and separation feeding means 153 (see FIG. 4), in the vertical direction upwards over sheet stacker 151, within space 280 (to be described later). Since pickup feeding means 152 and separation feeding means 153 are located around the center of the full width of the acceptable maximum sheet size H, the space with pickup solenoid 200 arranged therein lies in a space defined by translating the boundary areas of the acceptable maximum sheet width H and outside the full width, in the vertical direction upwards over sheet stacker 151. In this way, the feeding means directly relating to the sheets, such as pickup feeding means 152, separation feeding means 153 and the like are laid out in the sheet center with respect to the direction perpendicular to the sheet feeding direction while the means for supporting the means directly relating to the sheets are arranged in the boundary areas or areas outside the full sheet width, with respect to the direction perpendicular to the sheet conveying direction. Thus, it is possible to use space efficiently and hence make the apparatus compact by adjusting the layout of the functional units and parts relative to those nearby. Here, reference numerals 155, 149 and 302 designate a sheet stopper, a guide plate and a front frame, respectively.

The description as to the manual feeder is ended at this point.

Figure 16:
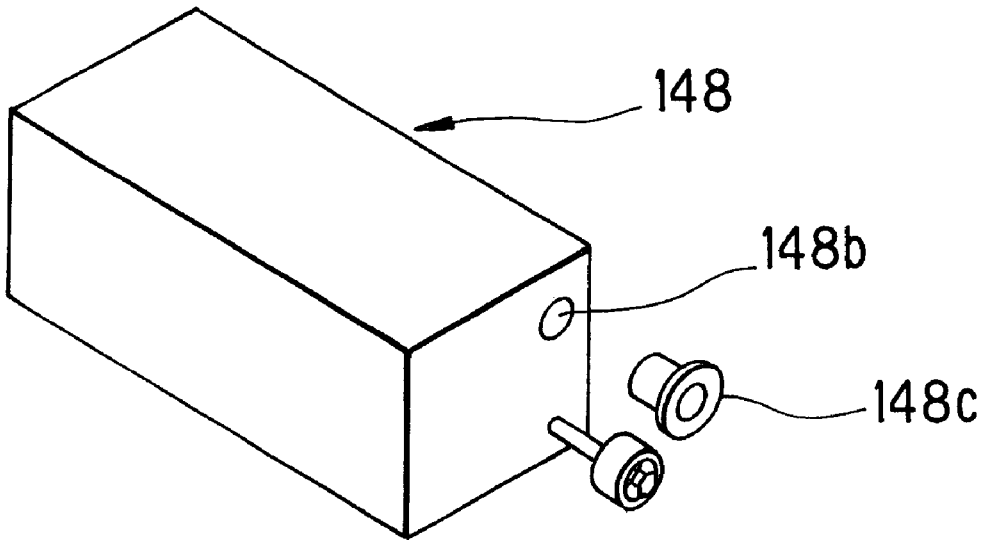
FIG. 16 is an exploded perspective view showing a developer collecting container.
Figure 17A:
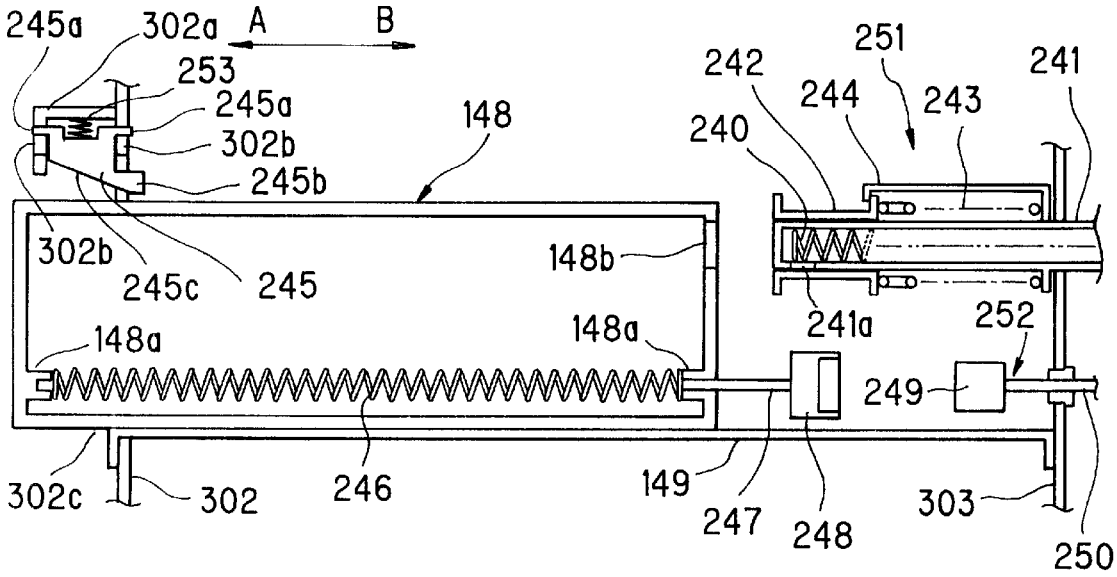
FIGS. 17A and 17B are sectional views showing a developer collecting container and a coupling portion on the main body side.
Figure 17B:
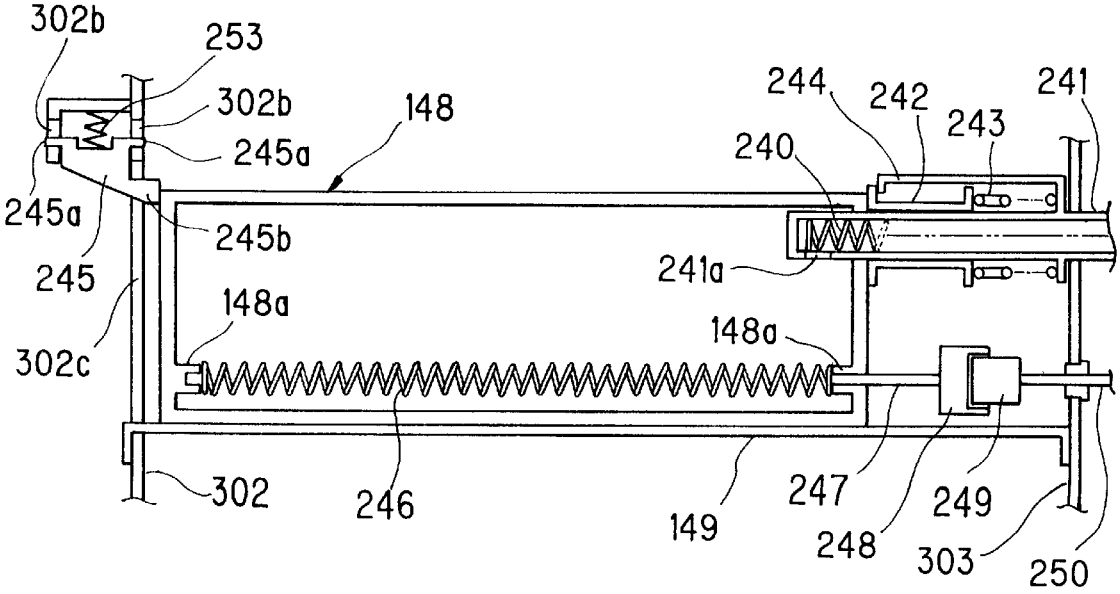

Next, referring to FIGS. 16 and 17A and 17B, a developer collecting container 148 will be described in detail. Here, FIG. 16 is an exploded perspective view of developer collecting container 148. FIGS. 17A and 17B are sectional views showing developer collecting container 148 and the copier body side coupling portion.

As shown in FIG. 17A, provided in the interior-side upper portion with respect to the attaching direction of developer collecting container 148 is a copier body-side coupler for developer conveyance 251 for conveying the developer collected from photosensitive member 51 by cleaner 57 (see FIG. 5) into developer collecting container 148. A copier body-side drive coupler 252 is arranged in the interior-side lower portion with respect to the attaching direction of developer collecting container 148, whereby the developer conveyed into developer collecting container 148 is sent to the exterior-side with resect to the attaching direction. As shown in FIG. 15, a coupling portion for developer collecting container 260 for coupling between developer collecting container 148 and copier body 1, is located between rear frame 303 and developer collecting container 148, or in a space defined by translating developer collecting container 148, to the interior side with respect to its attaching direction and in the interior side with respect to the attaching direction of manual feeder 150. As stated above, pickup solenoid 200 of manual feeder 150 is laid out between rear frame 303 and developer collecting container 148, or in a space defined by translating developer collecting container 148 to the interior side with respect to its attaching direction and to the exterior side with respect to the attaching direction of manual feeder 150.

Main body-side coupler for developer conveyance 251 comprises: a conveyance pipe element 241 fixed to rear frame 303, a developer conveying means 240 of a spiral configuration, disposed inside conveyance pipe element 241, so as to be rotated by the driving force from the copier body side; a shutter 242 which is urged by a shutter spring 243 toward the left side in FIGS. 17A and 17B and is movable between a closed position where an opening 241*a* formed at the end of conveyance pipe element 241 is closed thereby and an open position; and an attachment stopper 244 integrally formed with conveyance pipe element 241. Copier body-side drive coupler 252 comprises: a conveyance drive shaft 250 supported rotatably by a bearing disposed in rear frame 303 of the copier body; and a coupling 249 fixed thereto.

Provided on the front side with respect to the attaching direction of developer collecting container 148 are front frame 302 of the copier body, a securing stopper 245 having a flap 245*a* fitted into an opening 302*b* formed in a bent portion 302*a* of front frame 302 and a spring 253 urging securing stopper 245 downwards.

A coupling opening 148*b* is formed on the interior-side wall, of developer collecting container 148, in the attaching direction thereof. An in-container feeding means 246 is disposed inside developer collecting container 148 and is rotatably supported by a pair of bearings 148*a* provided on the interior walls of developer collecting container 148. This in-container feeding means 246 is fixed on the interior side to a feed shaft 247, to which coupling 248 as the drive coupler on the developer collecting container 148 side is fixed.

Next, referring FIGS. 16 and 17A and 17B, attachment and withdrawal of developer collecting container 148 with copier body 1 will be described.

As shown in FIG. 16, before attachment of developer collecting container 148 to copier body 1, cap 148*c* is removed so as to open coupling opening 148*b* for joining developer collecting container 148 to the coupling portion on the copier body side. Next, as shown in FIG. 17A, when developer collecting container 148 is inserted into the copier body through attachment mouth 302*c* formed in front frame 302 of the copier, the top edge of developer collecting container 148 abuts the inclined portion (245*c*) of securing stopper 245. As developer collecting container 148 is inserted, securing stopper 245 moves up opposing the elastic force of spring 253. So this stopper will not be an obstacle to the attachment of developer collecting container 148. As developer collecting container 148 is further pressed to the copier body interior (in the B-direction in the figure), the container slides over a guide plate 149 provided between front frame 302 fixed to the front-side chassis 300 of copier body 1 and rear frame 303 fixed to the rear-side chassis 301, toward rear frame 303.

As developer collecting container 148 is further inserted, shutter 242 residing at the closed position of opening 241*a* for preventing the developer from polluting the interior of the image processing apparatus, is moved to the right side in the figure, by being pressed by the exterior wall of developer collecting container 148 while the end of conveyance pipe element 241 is inserted into developer collecting container 148 through coupling opening 148*b* of developer collecting container 148.

As shown in FIG. 17B, when developer collecting container 148 is inserted to reach the position where a further movement of shutter 242 is stopped by attachment stopper 244, securing stopper 245 is moved by spring 253 to such a position as to engage the developer collecting container 148 to prevent developer collecting container 148 from being displaced. The end part of conveyance pipe element 241 fitted in developer collecting container 148 has its opening 241*a* exposed thus allowing the conveyance of the developer conveyed by developer conveying means 240 into developer collecting container 148. In this way, developer collecting container 148 has been attached to the predetermined position, and the coupling relating to the conveyance of the developer between developer collecting container 148 and the copier body side has been completed.

As developer collecting container 148 is being completely attached in place, coupling 248 and coupling 249 also fit to each other so that in-container feeding means 246 can rotate, thus the connection relating to the driving force transmission between developer collecting container 148 and copier body 1 also is completed.

By the above described mechanism, the developer conveyed by developer conveying means 240 falls into developer collecting container 143 from opening 241*a*, then the collected developer is conveyed by in-container feeding means 246 in the detaching direction of developer collecting container 148. Thus, the developer can be stored approximately uniformly across the bottom of developer collecting container 148, from the interior side to the exterior side.

For detachment of developer collecting container 148 from copier body 1, securing stopper 245 is lifted by hand, developer collecting container 148 is pushed out in the A-direction in the figure from the elastic force of shutter spring 243, the coupling relating to the developer conveyance and the coupling relating to the driving force transmission between developer collecting container 148 and copier body 1 (see FIG. 3) are freed. In this condition, developer collecting container 148 can be taken out from copier body 1 by the operator grasping the front end part of developer collecting container 148 and pulling it out.

Next, referring to FIGS. 6, 15 and 18A, 18B and 18C, the positional relationship between manual feeder 150 and developer collecting container 148 in their attached state will be described.

The depth of developer collecting container 148, with respect to the direction of attachment (the B-direction), is formed to some degree shorter than the width H of the acceptable maximum sheet P to be set on manual feeder 150, therefore, the container leaves some space in the interior side, with respect to the attaching direction of developer collecting container 148, not occupying the space across the full width of the acceptable maximum sheet, or not exceeding the side edge of the maximum sheet.

Figure 18A:
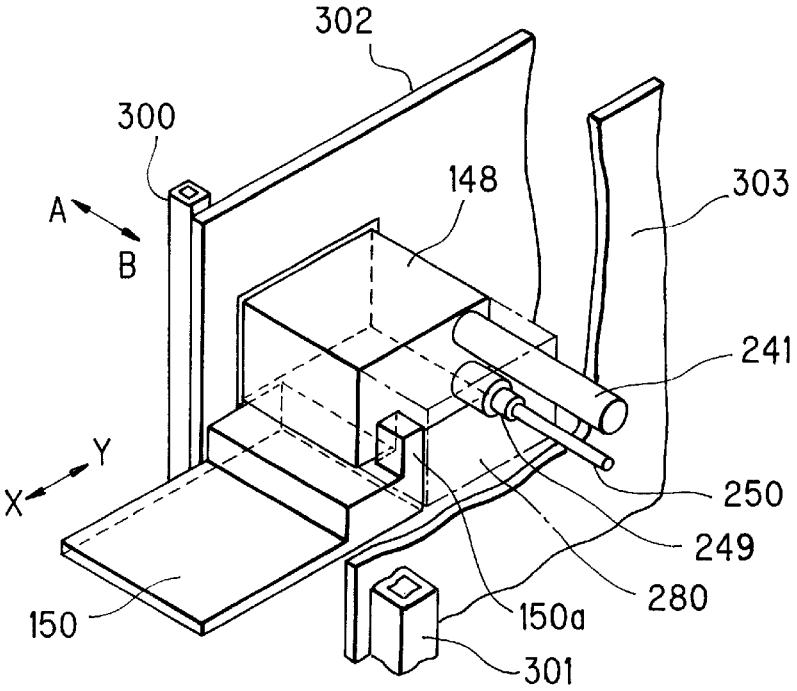
FIGS. 18A, 18B and 18C are perspective views showing a manual feeder and a developer collecting container in their attached state.
Figure 18B:
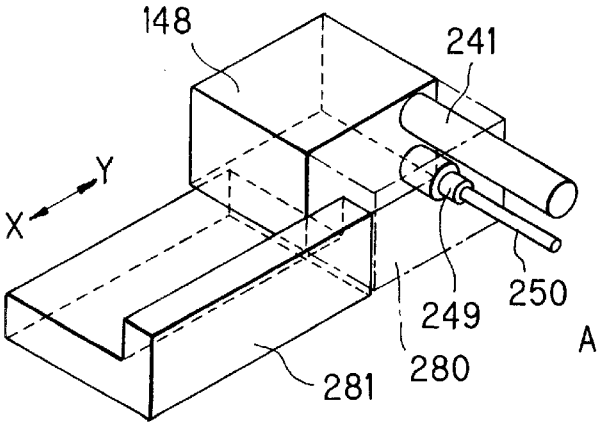
Figure 18C:
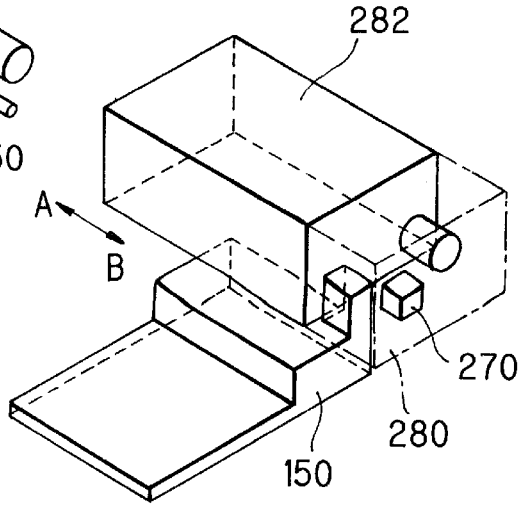

FIGS. 18A, 18B and 18C are perspective views showing manual feeder 150 and developer collecting container 148 in their attached state. As shown in FIGS. 18A, 18B and 18C, with manual feeder 150 and developer collecting container 148 in their attached state to copier body 1 (see FIG. 3), when developer collecting container 148 is translated in parallel in the attaching direction (in the B direction) of developer collecting container 148, a space of translation 280 is produced between developer collecting container 148 and rear frame 303. Here, this space of translation 280 does not include the space occupied by developer collecting container 148. Manual feeder 150 is attached in a manner that a part 150*a* of manual feeder 150 is located within this space 280. This part 150*a* of manual feeder 150 includes pickup solenoid 200, connector 271 and the like on the manual feeder 150 side. Arranged also within space 280 is a copier side connector 272. Here, reference numerals 300, 301 and 302 designate components in FIG. 18.

Developer collecting container 148 in its attached state, is arranged outside space 281 which is the path of manual feeder 150 (see FIG. 18B) during movement for the detachment (in the X-direction) and attachment in the Y-direction). Similarly, manual feeder 150 in its attached state, is arranged outside space 282 which is the path of developer collecting container 148 (see FIG. 18C) for movement. Further, parts 241, 249, 250 and 270 for coupling either manual feeder 150 or developer collecting container 148 to the copier body are arranged in areas so as not to interfere with movement for attachment and detachment of the other unit (FIGS. 18B and 18C).

In this way, when manual feeder 150 and developer collecting container 148 have been attached to copier body 1, these two components are arranged in the above described relationship, so that it is not necessary to shift one unit of the two when the other unit needs be attached or detached and hence the number of steps during attachment or detachment does not change. In this embodiment, since both of these two functional units has couplings with the copier body, the couplings on the copier side are arranged in predetermined positions within space 280 which will not interfere with the attachment and detachment of either functional units. However, this example does not mean that the couplings should be disposed necessarily within space 280. The couplings may be positioned anywhere as long as they will not be an obstacle to the attachment and detachment of other functional units. Also in this case, the volume of the space occupied by the couplings is small compared to that occupied by functional units, so it is possible to achieve efficient use of space.

Up to now, the manual feeder and developer collecting container, applied to the invention, have been described in detail.

Concerning the pickup feeder, the sheet stacking means of a fixed type is used in the above embodiment, but the present invention can also be applied to a pickup feeder of a up and down movable type. The separation feeding means of this embodiment uses a feed roller abutted against a separation pad but a variety of modifications can be made such as, for example, use of a feed roller abutted against a reversing roller, or a feed belt in place of a feed roller, etc. Further, as to the pickup feeding means, other modifications can be made such as use of a belt in place of a roller.

Further, instead of arranging a container for collecting the developer, it is also possible to arrange a developer supplying container for supplying the developer to developing means 54.

As the present invention has been described with the case of a manual feeder, the functional unit is not limited to the pickup feeder and/or develop collector, the present invention can be applied to other various types of functional units.

(The Second Embodiment)

Next, the second embodiment in accordance with the invention will be described with reference to FIGS. 19A, 19B, 19C, 20A and 20B. Here, the same components as those in the first embodiment will be allotted with the same reference numerals.

Figure 19A:
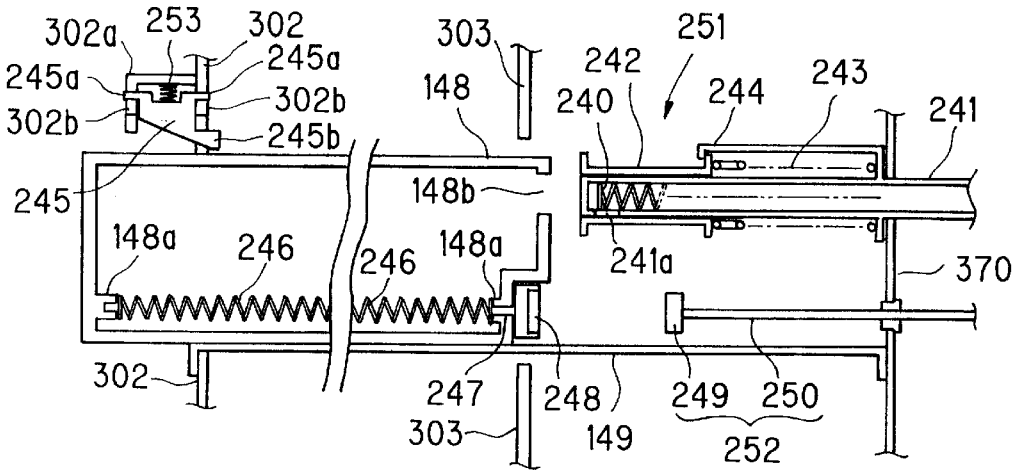
FIGS. 19A, 19B and 19C are sectional views showing the states of attaching procedures of a developer collecting container and a manual feeder according to the second embodiment.
Figure 19B:
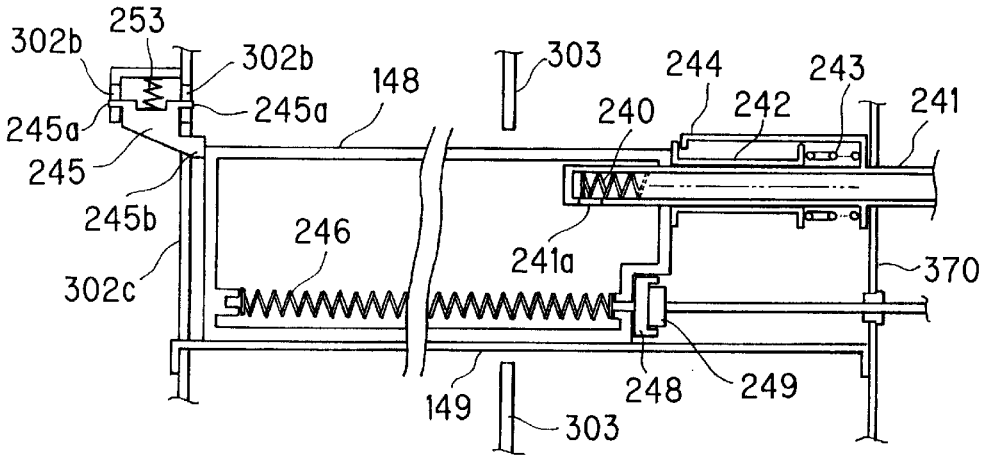
Figure 19C:
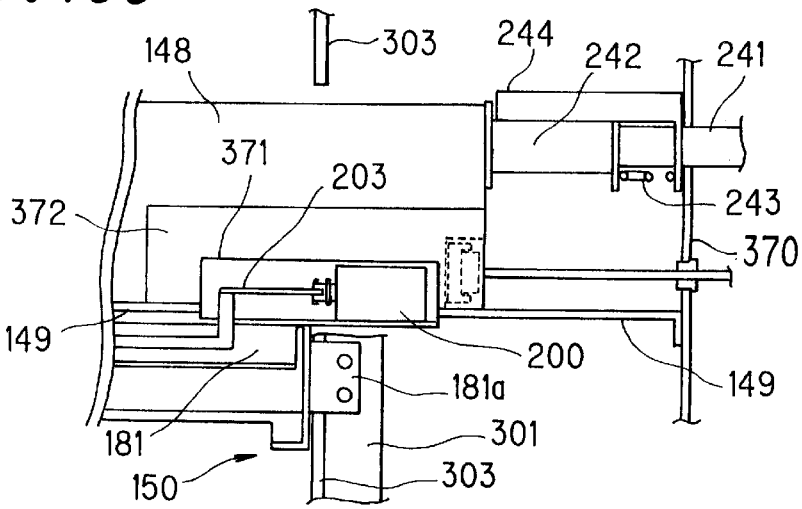
Figure 20A:
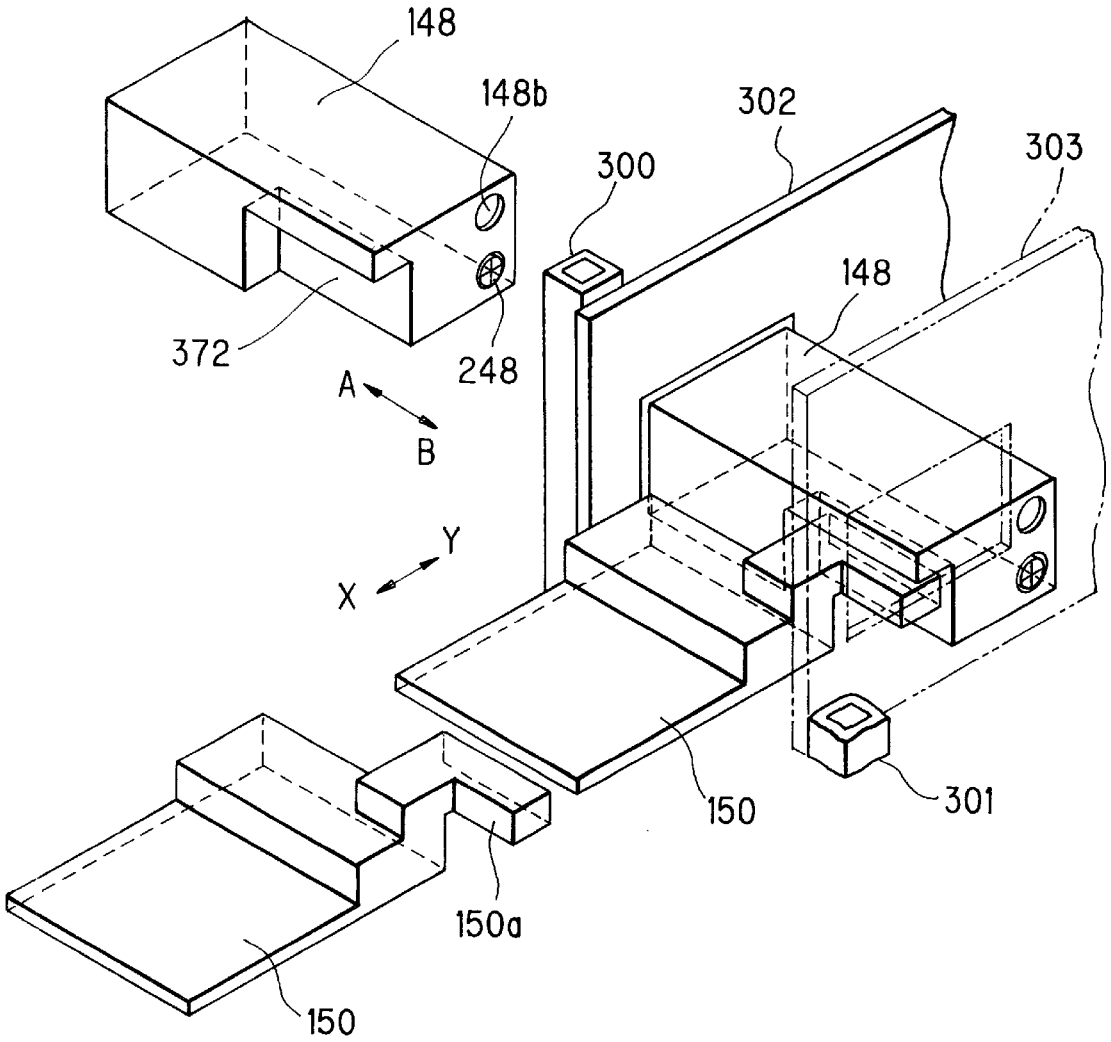
FIGS. 20A and 20B are perspective views showing a developer collecting container and a manual feeder according to the second embodiment, in their attached state.

The second embodiment is a sheet feeder 100 as a functional unit detachably arranged adjacent to another detachable functional unit of a copier, a developer collecting container 148. In this embodiment, the drive transmission assembly for transmitting a driving force to the feeding-related means which moves between the active and inactive positions, is disposed in a space defined by translating an area beyond the full width of the acceptable maximum size of the sheets set on the sheet stacking means, in the direction of the thickness of the sheets. FIGS. 19A, 19B and 19C are sectional views showing developer collecting container 148 and manual feeder 150 in their attached state. FIG. 20A is a perspective view showing manual feeder 150 and developer collecting container 148 in their attached state.

FIG. 19A shows a state where developer collecting container 148 is about to be attached, FIG. 19B shows a state where developer collecting container 148 has been attached in place, and FIG. 19C shows a state around rear frame 303 of the copier body with two functional units, i.e., developer collecting container 148 and manual feeder 150 attached in place. In order to further increase the volume of the developer collecting container 148 shown in FIG. 15 of the first embodiment, the developer collecting container of this embodiment is configured as shown in FIGS. 19A, 19B and 19C, so that when it is attached, the rear-side container wall with respect to the attaching direction of developer collecting container 148 is projected out beyond rear frame 303. In this case, copier body-side coupler for developer conveyance 251 and conveyance drive shaft 250 are supported by another supporter plate 370 fixed to rear frame 303.

The operations concerning the attachment and detachment of developer collecting container 148 are the same as the first embodiment so the description will not be repeated.

As shown in FIG. 19C, pickup solenoid 200 as a part of manual feeder 150 is supported by a supporter plate 371 fixed to feeder frame 181 and is arranged in a depressed portion 372 formed in developer collecting container 148. Pickup solenoid 200 is coupled with lever 203.

In this way, lever 203 as a shifting means for shifting the pickup feeding means 152 between the active and inactive positions, resides in a space which is defined by translating the central area of the full width of the acceptable maximum size sheet, in the direction of the sheet thickness. When the space of the path of pickup feeding means 152 for movement between its active and inactive positions, is arranged so as to be in contact with two planes perpendicular to the direction of the sheet thickness, lever 203 moves within the space between the two planes. Lever 203 extends to a space defined by translating the outside area beyond the edge of the width of the acceptable maximum sheet, in the direction of the sheet thickness. Further, since this lever 203 moves along the longitudinal direction thereof to transmit the driving force, this configuration does not need much space for the movement, thus contributing to miniaturization of manual feeder 150.

Figure 20B:
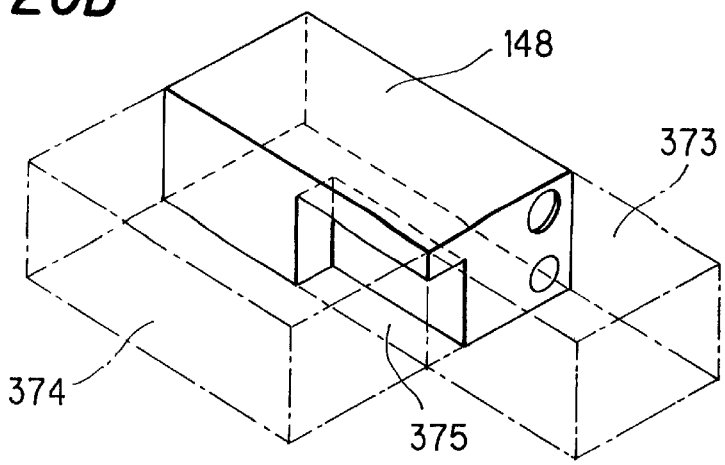

Next, the positional relationship between developer collecting container 148 and manual feeder 150 in their attached state, will be described with reference to FIGS. 20A and 20B. As shown in FIG. 20B, pickup solenoid 200 is arranged in part 150*a* of manual feeder 150, within the space overlapped by a space 373 which is defined by translating the developer collecting container 148 in the attaching direction thereof and another space 374 which is defined by translating the developer collecting container 148 in the detached direction of manual feeder 150, and yet within a space 375 which is outside the space occupied by developer collecting container 148. This arrangement enables both the increase in volume of developer collecting container 148 and the attachment and detachment of manual feeder 150.

In this embodiment, since developer collecting container 148 is attached by being slid in the B-direction in FIG. 20A and detached by being slid in the A-direction, the attachment and detachment are the same as in the case of the above first embodiment. On the contrary, manual feeder 150 is attached by fitting the portion of feeder clutch 194 and its input gear 194*a*, and the portion of pickup solenoid 200 (see FIG. 7) into an opening 303*b* (not shown) formed in rear frame 303, with manual feeder 150 kept angled with respect to the copier body, and then moving the feeder in the Y-direction. Fixture of manual feeder 150 is the same as in the first embodiment. Thereafter, the couplers for electrical connection are coupled by hand in the same manner as in the first embodiment, to complete the attachment of manual feeder 150. The detachment of manual feeder 150 is performed in the reverse direction to that above.

As the present invention has been described with the case of a manual feeder, the functional unit is not limited to the pickup feeder and develop collector, the present invention can be applied to other various types of functional units.

(The Third Embodiment)

Next, the third embodiment will be described with reference to FIGS. 21A, 21B through 26A, 26B. Here, the same components as those in the above embodiments will be allotted with the same reference numerals.

Figure 21A:
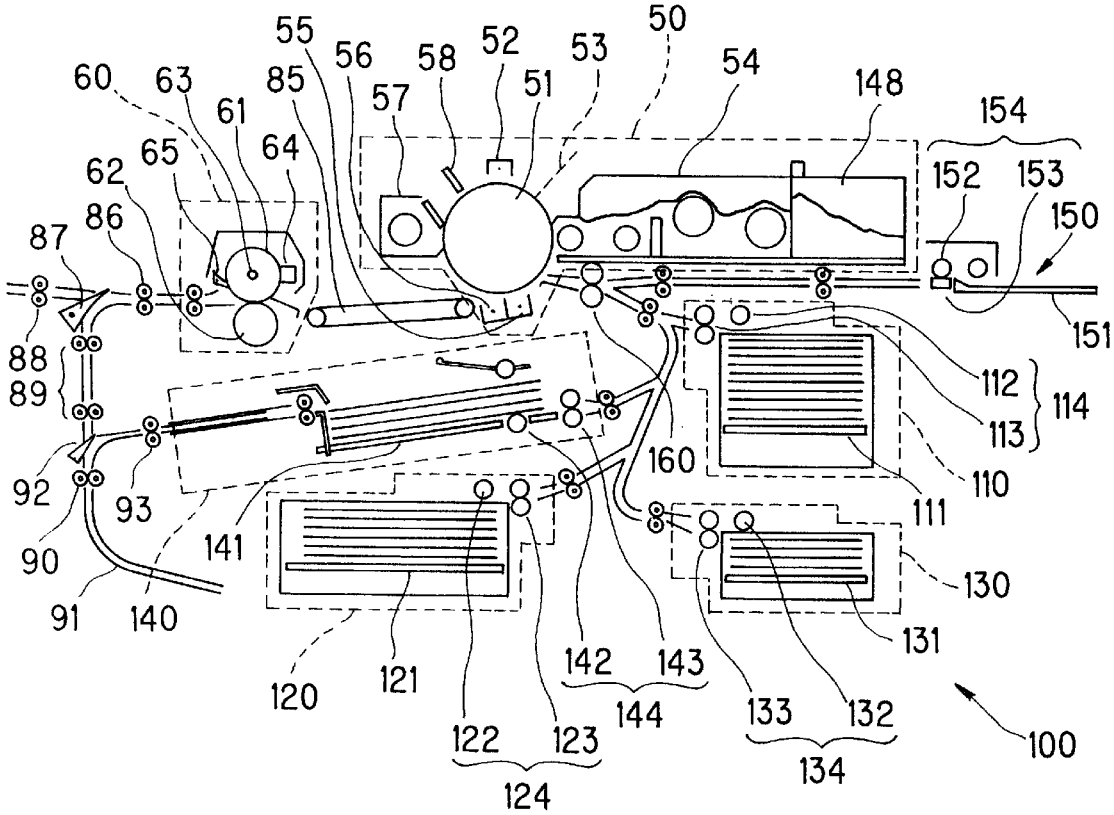
FIGS. 21A and 21B are sectional views showing the third embodiment of a copier as an image processing apparatus in accordance with the invention.
Figure 21B:
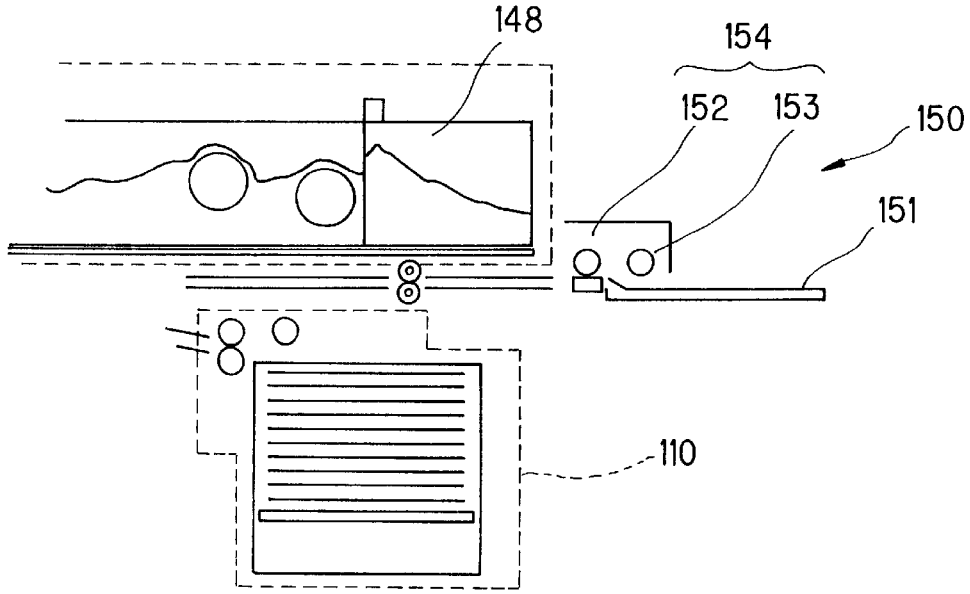

FIGS. 21A and 21B are sectional views of a copier body 1 of the third embodiment. FIG. 21A is an overall sectional view and FIG. 21B is an enlarged view showing essential parts. The basic configuration of the third embodiment is almost the same as the first embodiment, except in that a feeder unit 154 of manual feeder 150 is provided on the side next to developer collecting container 148 and excepting the configuration of developer collecting container 148 and parts relating to its attachment and detachment. Disposed below a guide plate 149 for guiding attachment and detachment of developer collecting container 148, are the sheet conveying means and sheet conveyance guide.

Figure 22A:
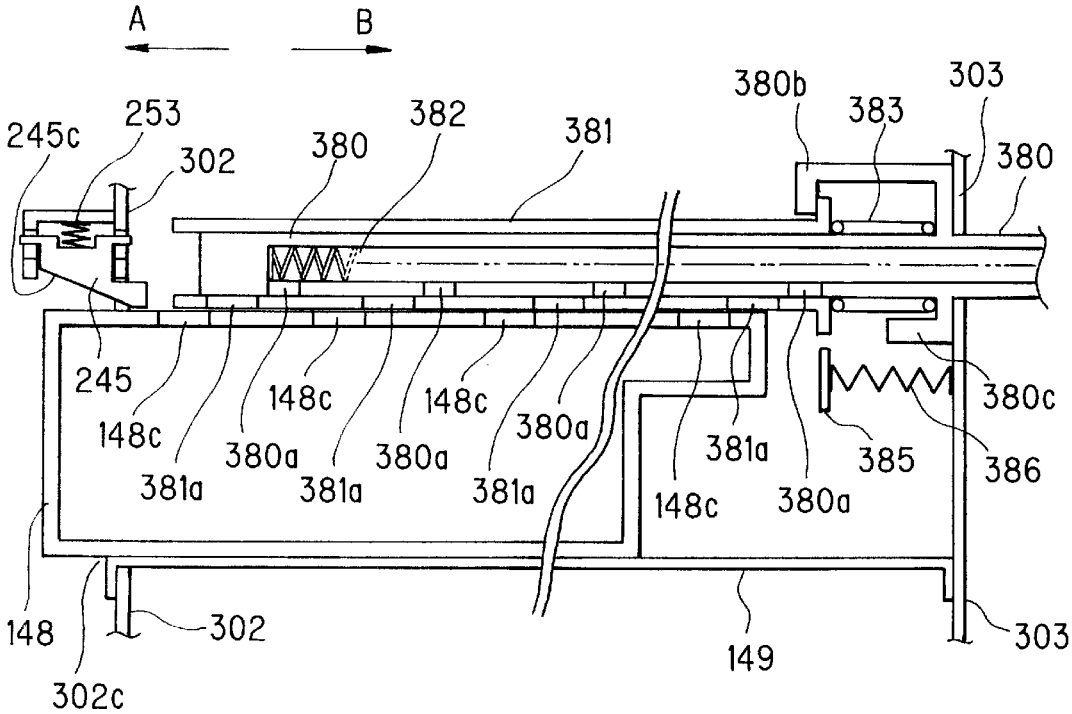
FIGS. 22A and 22B are sectional views showing a developer collecting container of the third embodiment, in its attached state.
Figure 22B:
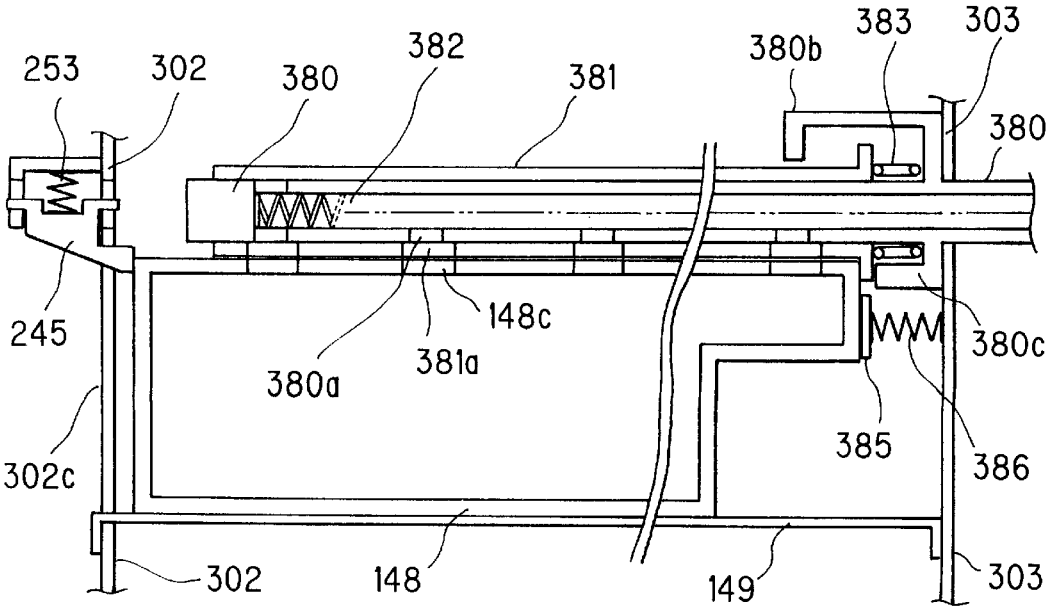

Now, as to developer collecting container 148 and parts for attachment and detachment therefor will be described with reference to FIGS. 22A and 22B. Here, FIGS. 22A and 22B are sectional views showing developer collecting container 148 in its attached state.

The top wall of developer collecting container 148 is formed with a plurality of openings 148*c*. A conveyance pipe element 380 for conveying the developer to developer collecting container 148, is fixed to rear frame 303. Formed on the underside of conveyance pipe element 380 are a plurality of discharge openings 380*a*. A shutter 381 is provided around the conveyance pipe element 380. Shutter 381 also has openings 381*a*. Part of conveyance pipe element 380 constitutes a stopper 380*b* for shutter 381. A spring 383 is provided between shutter 381 and a flange 380*c* of conveyance pipe element 380. Conveyance pipe element 380 has a hollow in which a developer conveying screw 382 for conveying the developer from cleaner 57 (see FIG. 21A).

Attachment of developer collecting container 148 is described with reference to FIGS. 22A and 22B.

When inserted into the copier body through attachment mouth 302*c* formed in front frame 302, the top edge on the interior side with respect to the attaching direction of developer collecting container 148 abuts the inclined portion (245*c*) of securing stopper 245 and raises securing stopper 245 opposing the elastic force of spring 253. As developer collecting container 148 moves in the B-direction over guide plate 149, the container wall on the interior side with respect to the attaching direction of developer collecting container 148, presses shutter 381, opposing spring 383. Further, as developer collecting container 148 slides until shutter 381 abuts the slide stopper, i.e., a flange 380*c*, securing stopper 245 is pressed down by spring 253, to thereby prohibit developer collecting container 148 from being pulled out. Thus, the attachment of developer collecting container 148 is completed. When developer collecting container 148 is completely attached, a detachment spring 386 interposed between a separation assist plate 385 and rear frame 303 is compressed. When developer collecting container 148 is completely attached, openings 381*a* of shutter 381, discharge openings 380*a* of conveyance pipe element 380, openings 148*c* of developer collector container 148 are all aligned with one another forming paths so that the developer conveyed by developer conveying screw 382 can be discharged therethrough into developer collecting container 148.

For detachment of developer collecting container 148 from copier body 1 (see FIG. 22B), securing stopper 245 is lifted by a hand, to undo the engagement. Then, developer collecting container 148 is pushed out in the A-direction by detachment assist plate 385 due to the action of the elastic force of spring 383. As developer collecting container 148 moves in the A-direction, shutter 381 also moves in the same direction and abuts a stopper 380*b* and stops at that point. In this situation, openings 381a of shutter 381 and discharge openings 380*a* of conveyance pipe element 380 are closed, so no developer will leak. After developer collecting container 148 has been pulled out of the copier, openings 148*c* of developer collecting container 148 are covered with a container lid so as to prevent the developer from leaking from developer collecting container 148.

Figure 23:
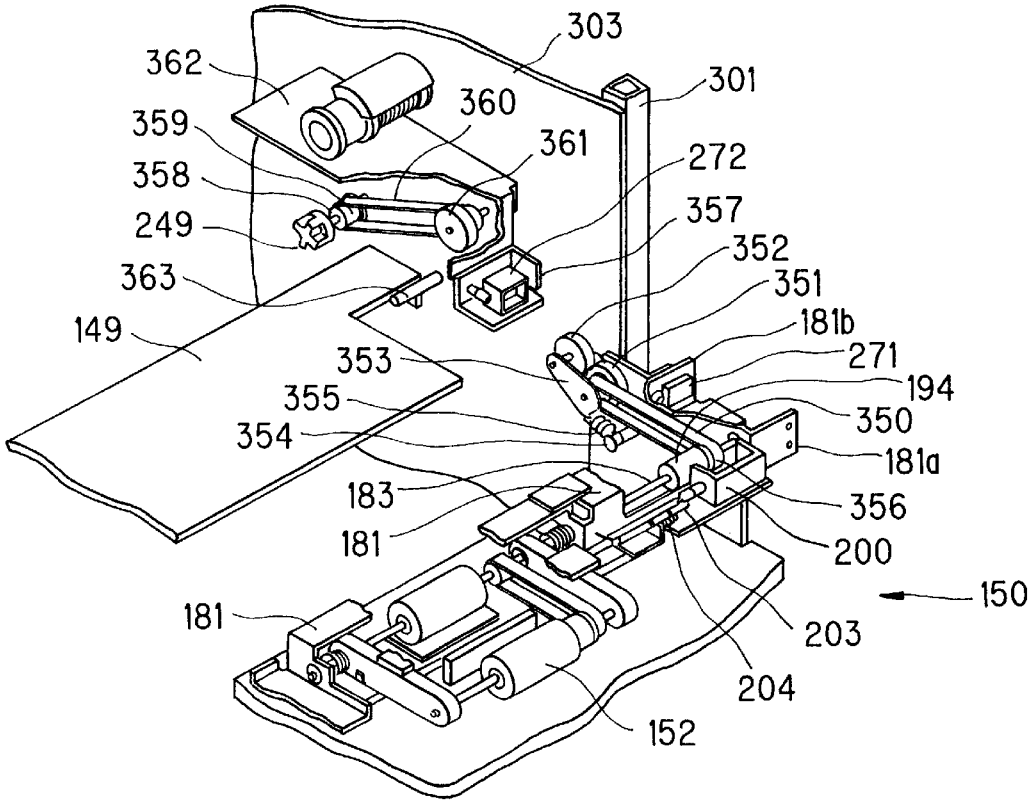
FIG. 23 is a perspective view showing a manual feeder in accordance with the third embodiment, before its attachment.
Figure 24:
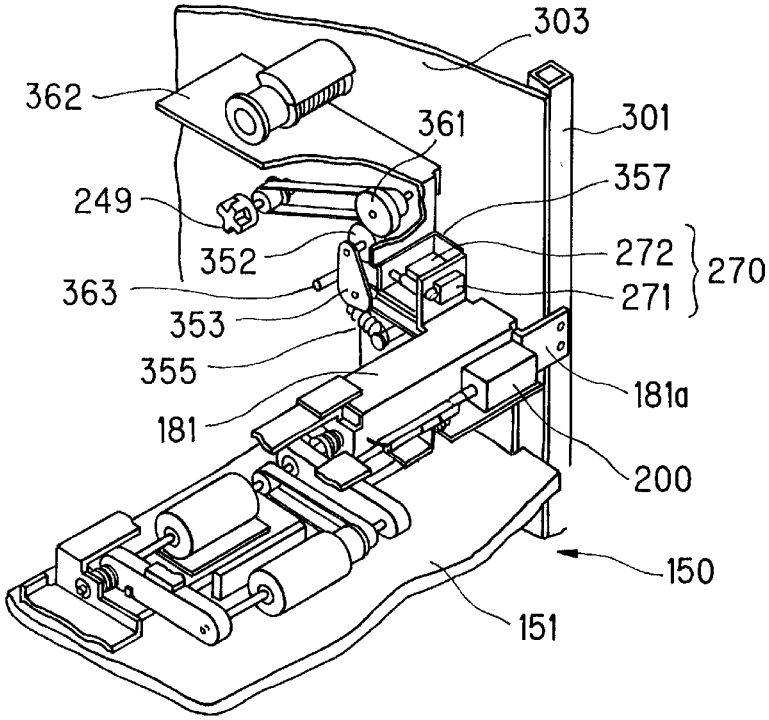
FIG. 24 is a perspective view showing a manual feeder in accordance with the third embodiment, in its attached state.

Next, referring to FIGS. 23 and 24, the configuration of a manual feeder 150 and the attachment and detachment thereof will be described. FIG. 23 is a perspective view showing a state before attachment of manual feeder 150. FIG. 24 is a perspective view showing the attached state of manual feeder 150.

A pickup solenoid 200 for moving a pickup feeding means 152 of manual feeder 150 up and down is fixed to the step where a return spring 204 of feeder frame 181 is disposed. Pickup solenoid 200 is coupled with a lever 203. The operations of these elements are the same as in the first embodiment.

Fixed to a bent portion 181*b* of feeder frame 181 is a manual feeder-side connector 271. A feeder clutch 194 and pulley 356 are arranged on a drive input shaft 183 rotatably supported by feeder frame 181. A pulley/gear 351 having a pulley and a gear integrally formed is rotatably supported on feeder frame 181. The rotary shaft of pulley/gear 351 is supported by a drive coupling plate 353 while an input gear 352 which is meshed with the gear portion of pulley/gear 351 is also supported by drive coupling plate 353. A spring 355 is hooked between drive coupling plate 353 and a boss 354. A belt 350 is wound between pulley 356 and the pulley portion of pulley/gear 351.

Drive force transmitted from input gear 352 is transferred from pulley/gear 351 to pulley 356 via belt 350. When feeder clutch 194 is on, the driving force is transmitted to drive input shaft 183, whereas when feeder clutch 194 is off, no drive force will be transmitted to drive input shaft 183.

Fixed on rear frame 303 of the copier body side is a connector fixture plate 357 which holds a copier-side connector 272. An output shaft 358 has a coupling 249 for rotating in-container feed means 246 of developer collecting container 148, fixed at its distal end, and is provided with a pulley 359. A pulley/gear 361 is rotatably supported on rear frame 303 while a belt 360 is wound between pulley gear 361 and pulley 359. Rear frame 303 further has an upright boss 363 thereon and a shielding plate 362 fixed thereto.

When manual feeder 150 has been fixed to front chassis 300 (see FIG. 25) and rear chassis 301 to complete the attachment to copier body 1 (see FIG. 3), connector 272 on the copier side and connector 271 on the manual feeder side are joined as shown in FIG. 24 to complete the coupling of coupling portion 270 relating to electrical connection of this embodiment. As a result, sheet set sensor S1 (see FIG. 25) provided for manual feeder 150 and pickup solenoid 200 can operate.

During attachment of manual feeder 150, when drive coupling plate 353 abuts boss 363, drive coupling plate 353 rotates upward about rotary shaft of pulley/gear 351 (see FIG. 23), opposing spring 355, so input gear 352 also goes up. When manual feeder 150 has been completely attached, input gear 352 meshes the gear portion of pulley/gear 361, thus the driving force from the copier body side can be transmitted to manual feeder 150. Conversely, when manual feeder 150 is pulled out, drive coupling plate 353 is pulled by spring 355 so that it goes down together with input gear 352. Because of this configuration, connector fixture plate 357 will not be an obstacle when manual feeder 150 is attached and detached.

When manual feeder 150 and developer collecting container 148 (not shown in FIGS. 25 and 26) are attached, shielding plate 362 and connector fixture plate 357 shield the coupling portions of manual feeder 150 and developer collecting container 148, specifically, the coupling portion relating to developer conveyance, the coupling portion relating to drive input and coupling portion 270 (see FIG. 24) relating to electrical connection so as to partition each coupling means from the others.

Figure 25:
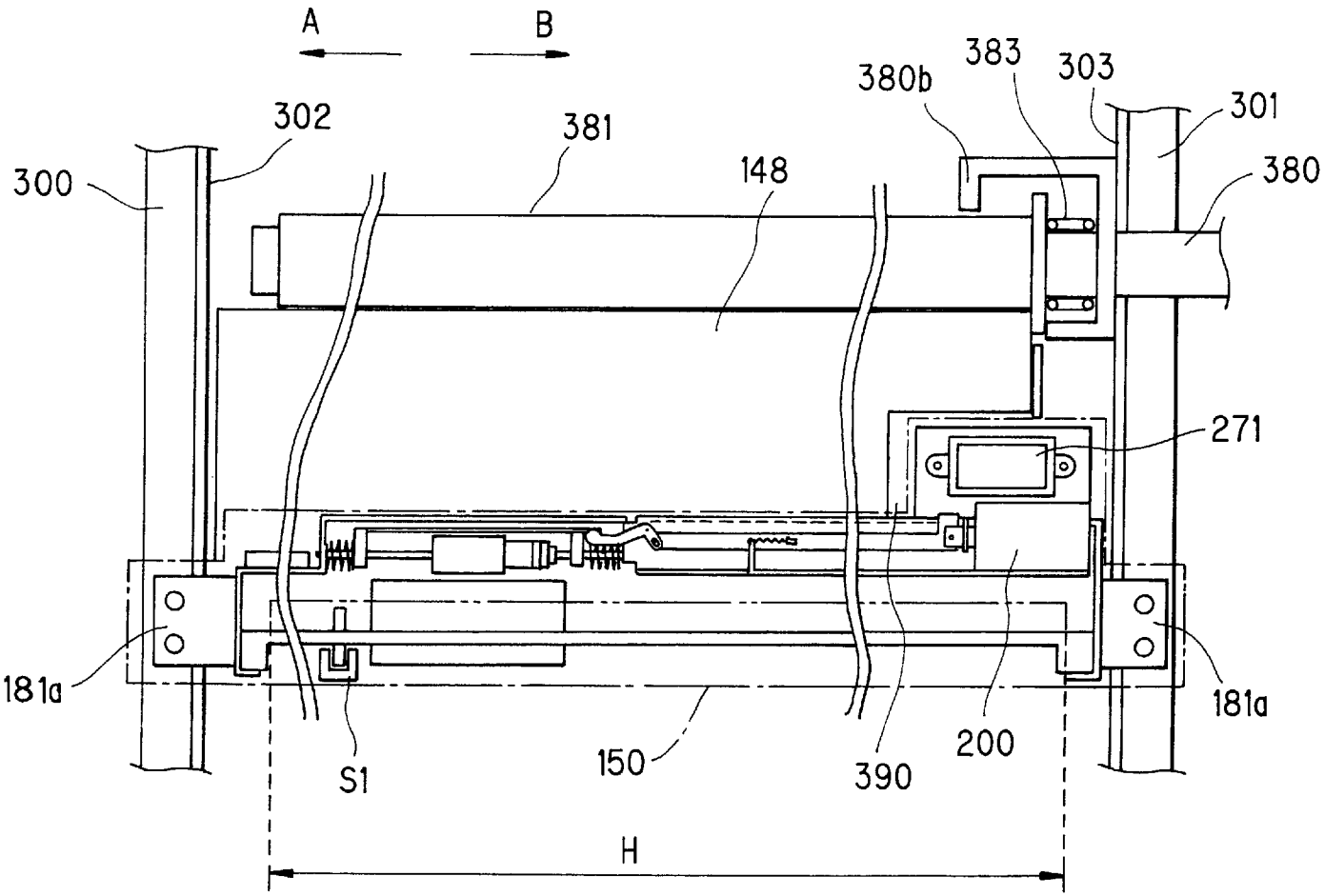
FIG. 25 is a sectional view showing a manual feeder and a developer collecting container in accordance with the third embodiment, in their attached state to a copier body.
Figure 26A:
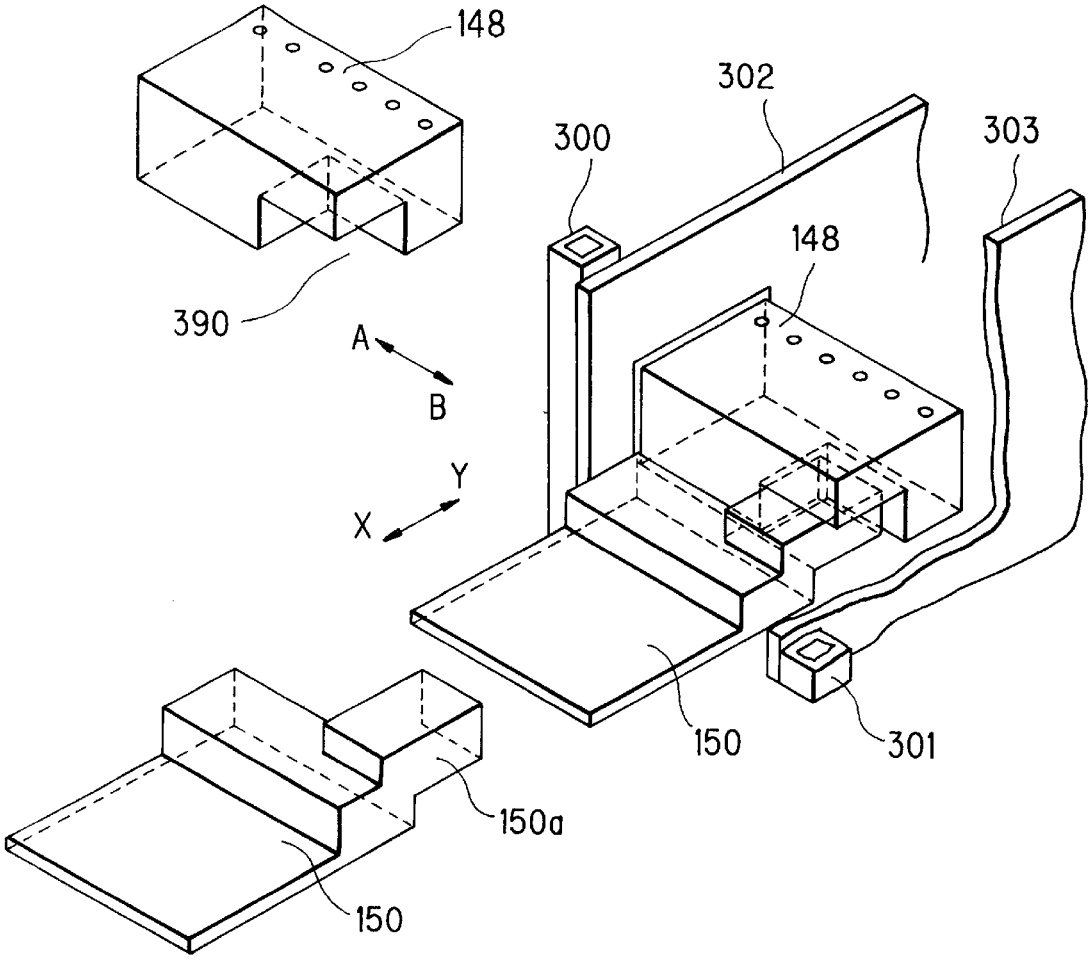
FIGS. 26A and 26B are perspective views showing a manual feeder and a developer collecting container in accordance with the third embodiment, in their attached state.
Figure 26B:
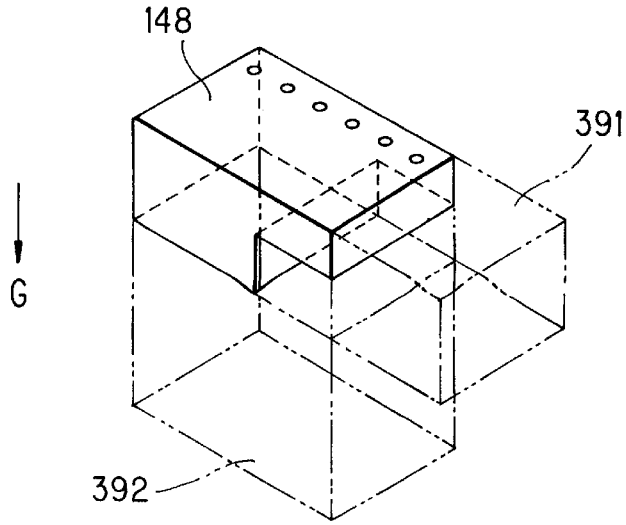

The relationship of the arrangement between manual feeder 150 and developer collecting container 148 will be described with reference to FIGS. 25 and 26A and 26B. FIG. 25 is a sectional view showing manual feeder 150 and developer collecting container 148 in their attached state to copier body 1 (see FIG. 3), viewed from the side where manual feeder 150 is attached or detached with respect to copier body. FIG. 26A is a perspective view showing the attached state of manual feeder 150 and developer collecting container 148.

Developer collecting container 148 has a depressed portion 390, where the coupler for coupling manual feeder 150 to copier body 1 (see FIG. 3) is laid out. As shown in FIG. 26B, part 150*a* of manual feeder 150 is arranged, within the space overlapped by a space 391 which is defined by translating developer collecting container 148 in its attached position in the attaching direction (the B-direction) and another space 392 which is defined by translating developer collecting container 148 in the direction (the G-direction) substantially perpendicular to the attaching direction (the B-direction), and yet within a space 390 which is outside the space occupied by developer collecting container 148, as shown in FIG. 26A. As already described, the coupling portion for coupling manual feeder 150 with copier body 1 is laid out in this part 150*a* of manual feeder 150.

(The Fourth Embodiment)

As shown in FIG. 15, the left side portion of pickup feeding means 152 and feed roller 180 of manual feeder 150 is configured in a step-like form, as shown in FIG. 15, and this space is not used. For the purpose of using this wasted space, the volume of developer collecting container 148 is increased to enlarge developing collecting container 148.

Figure 27:
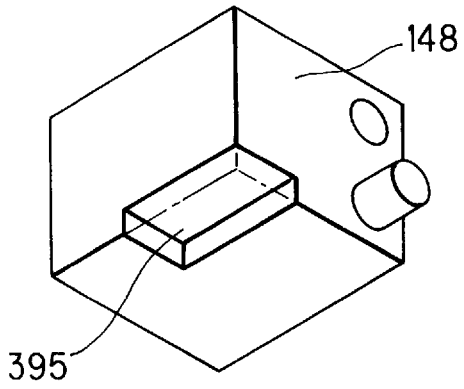
FIG. 27 is a perspective view showing a developer collecting container in accordance with the fourth embodiment.
Figure 28:
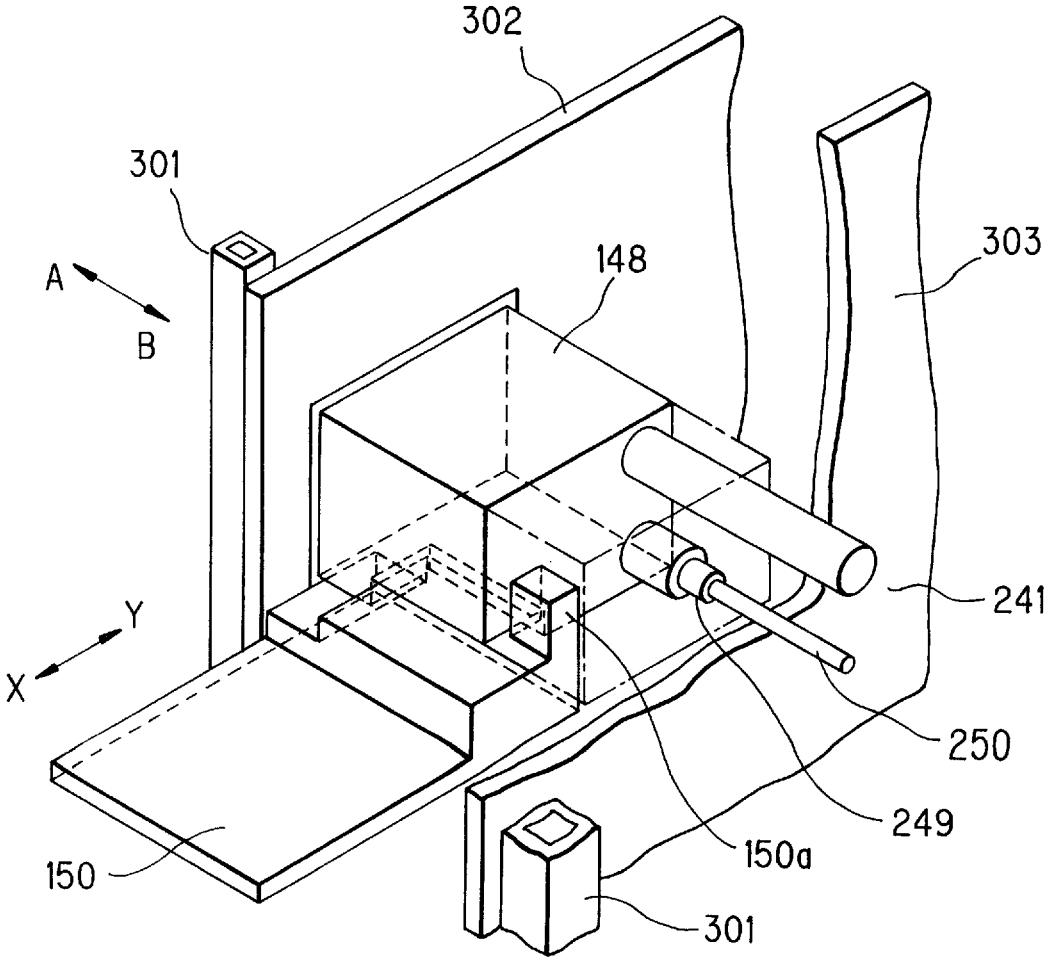
FIG. 28 is a perspective view showing a manual feeder and a developer collecting container in their attached state in accordance with the fourth embodiment.

FIG. 27 is a perspective view showing a developer collecting container 148. FIG. 28 is a perspective view showing a manual feeder and a developer collecting container in their attached state. Since unused space is present on the bottom side of developer collecting container 148, if the volume to be utilized is simply added to developer collecting container 148, the stability of developer collecting container 148 when it is placed outside the machine cannot be ensured. To deal with this, all the bottom surface is enlarged by the height of the space to be efficiently used, to thereby produce a good stability when it is placed outside the machine. As shown in FIGS. 27 and 28, the bottom area of developer collecting container 148 is formed with a depressed portion 395, which is the space occupied by pickup feeding means 152 and feed roller 180 when they are attached. In the above first to third embodiments, the same components are allotted with the same reference numerals for the purpose of simplifying the description.

Since the amount of collection of the developer, that is, the amount of the leftover developer on the photosensitive member, which has not been transferred to the sheet during transfer, is very small compared to the supplied amount of the developer, a small increase in volume is effective to prolong the time of replacement of developer collecting container 148 to some practical extent.

As in this case, when a functional unit has a primary function of collecting a fluid matter such as a developer, etc., it is convenient to enhance the function because the container of the fluid matter can be modified as to its shape without affecting the function.

In the above, a developer collecting container 148 having the function of holding the collected developer was used as an example of a container of a fluid matter, to explain the present embodiments, because its high efficiency. However, the container of a fluid matter may be a developer supply container for storing the developer for supply, may be an agitating chamber which is provided in the developing means for agitating the developer, or may be a collecting chamber of a cleaner, for temporarily storing the leftover developer removed from the photosensitive member.

As the present invention has been described with the case of a manual feeder, the functional unit is not limited to the pickup feeder and develop collector, the present invention can be applied to other various types of functional units.

In accordance with the present invention, in the space of the path for movement of a functional unit when it is attached or detached no part of other functional units are located other than the functional unit which is being attached or detached. Therefore, when the functional unit is attached or detached, no manipulative operation is needed such as moving, attaching and detaching any other functional unit. Thus a simple attachment and detachment of a functional unit can be ensured. Further, the layout of the parts within each functional unit can be modified so as to arrange a certain part of the functional unit in an unused space, without losing the operativity of the attachment and detachment of the functional unit and other functional units, thus making it possible to reduce the volume of the space occupied by the functional unit itself. Resultantly, it is possible to miniaturize the image processing apparatus.

In accordance with the fourth feature of the invention, one of the multiple functional units has a first functional portion which directly comes in contact with the sheets and directly relates to sheet feeding and a second functional portion which relates to sheet feeding but is kept away of the sheets, and the first functional unit is arranged for attachment within a space which is defined by translating an area extending in the direction perpendicular to sheet feeding direction and having the full width of the acceptable maximum size sheet, in the direction normal to the sheet feeding surface. Accordingly, it is possible to secure an adequate movable range within which the first functional portion moves between the contact and separated positions. Further, since the second functional unit is arranged for attachment within a space which is defined by translating an area lying in the direction perpendicular to sheet feeding direction but outside the full width of the acceptable maximum size sheet, in the direction normal to the sheet feeding surface, the image processing apparatus can be configured to be thinner.

In accordance with the fifth feature of the invention, a multiple number of connector means of the functional units adjacently disposed within the image processing apparatus for coupling them to the main apparatus body side, such as connector means for connecting the power lines and signal lines of the functional units with the main apparatus body, drive coupling means for receiving the driving forces for functional units from the main apparatus side, or the coupling portion for the developer conveying means for inputting the developer to, or outputting the developer from, a container, are not arranged diversely but are laid out integrally. Therefore, a greater space can be secured inside the machine body, and hence it is possible to enhance the flexibility of the layout of other functional units and parts to be arranged within the image processing apparatus. Thus, the design for miniaturization of an image processing apparatus can be further promoted. Coupling means on the main apparatus side can be further localized and integrated into units. This also improves the assembly performance as to the main machine side.

In accordance with the sixth feature of the invention, since multiple coupling means of the same type of adjacent functional units are laid out close to each other, the coupling means of the same type can be arranged closely also on the main apparatus side. Because each coupling means was disposed away from others in the conventional configuration, separate parts were needed for the coupling means. However, as a result of the above configuration, common parts can be used and hence the number of parts can be reduced, so that coupling means of the same type can be integrated into units and hence can be made compact. Further, for example, when connector means and drive coupling means are arranged closely, the lubricant for the drive coupling means may adhere to the connector means causing trouble with electrical connection. Alternatively, when connector means, drive coupling means and the coupling portion of the developer conveying means are laid out together, the developer may scatter from the coupling portion of the developer conveying means and adhere to the connector means causing trouble with electrical connection, or may adhere to the drive coupling means lowering the wear resistance. The present configuration can eliminate such adverse effects from different types of adjacent coupling means when different types of coupling means are laid out without being themselves separated.

In accordance with the seventh feature of the invention, since the functional unit is one which has a geometric flexibility in its volumed part, such as a container for a fluid matter, or in other words, since the functional unit is a container which can be modified in shape and dimensions to some extent, the flexibility of the layout of adjacent functional units within the image processing apparatus can be enhanced, thus increasing the capacity of the container and enhancing the design flexibility for miniaturization of the image processing apparatus.

In accordance with the eighth feature of the invention, the transmitting element for shifting the sheet-feeding related means between the active position and the inactive position can be extended to the space which is defined by translating a boundary area of the full width of the maximum size sheet in the direction of the sheet thickness, or can be extended to the space which is defined by translating an area beyond the full width of the maximum in the direction of the sheet thickness, and hence the drive source for driving the transmitting element can also be laid out within the space. As a result, the sheet feeder can be made thinner with respect to the direction of the sheet thickness, around the mid area across the sheet width where the sheet-feeding related means that moves between the active and inactive positions is arranged. Accordingly, when another functional unit having functional parts relating to the sheets is laid out adjacent to the sheet feeder inside the image information processing apparatus, no wasted space will arise between the sheet feeder and the other functional unit. Resultantly, it is possible to promote miniaturization of the image information processing apparatus whilst keeping the ease of attachment and detachment of the sheet feeder and other units.

In accordance with the ninth feature of the invention, in addition to the effects of the above eighth feature, since the drive transmitting element for shifting the sheet-feeding related means between the active position and the inactive position, can be extended, in the direction perpendicular to the sheet feeding direction, to the space which is defined by translating a boundary area of the full width of the maximum size sheet in the direction of the sheet thickness, or can be extended, in the direction perpendicular to the sheet feeding direction, to the space which is defined by translating an area beyond the full width of the maximum in the direction of the sheet thickness, and hence the drive source for driving the transmitting element can also be laid out within the space. As a result, it is possible to create open space around the sheets except on the leading side thereof with respect to the sheet feeding direction. Accordingly, when the sheet stacking means of a sheet feeder is exposed outside the image information processing apparatus (for example, in the case of a manual feeder or the like), a large open space can be secured over the sheets and hence enabling easy setting of the sheets onto sheet stacking means. On the other hand, the sheet stacking means of a sheet feeder is provided inside the image information processing apparatus (for example in the case of a drawer type sheet feed cassette, etc.), the open space can be used for the arrangement of other parts or adjacent functional units, thus making it possible to promote miniaturization of the image information processing apparatus.

In accordance with the tenth feature of the invention, concerning the driving force transmitting elements for transmitting a driving force for shifting the pickup feeding means as a functional part relating to the sheet, between the active and inactive position, the drive transmission path to the pickup feeder means is configured so that the rotary driving force transmitting element is disposed closer to the pickup feeding means than the parallel movement type transmitting element. As a result, the driving force transmitting elements do not project more when compared with the case where the pickup feeding means is shifted by a rotary type drive transmitting element and a drive source coupled therewith. Further, since a drive source comparable to or greater in size than the pickup feeding means, can be arranged freely away from the pickup feeding means, it is also possible to eliminate wasted space or vacant space by adjusting the geometry relative to adjacent functional units, otherwise the drive source bulges out and hence wasted space will be created with other adjacent functional units when the sheet feeder is attached inside the image information processing apparatus. Moreover, even when a driving force transmitting element is reciprocated by providing a means for switching the moving direction of the driving force transmitting element (clutch, etc.), instead of using a solenoid and/or a spring, in a space defined, in the direction perpendicular to the sheet feeding direction, by translating an area beyond the full width of the maximum in the direction of the sheet thickness, it is possible to easily extend, the driving force transmitting element, if it is of a parallel movement type, to the space generated, in the direction perpendicular to the sheet feeding direction, by translating an area beyond the full width of the maximum in the direction of the sheet thickness. (If a rotary type driving force transmitting element is extended, it needs a much greater space for movement because it moves in a rotational manner.)

In accordance with the eleventh feature of the invention, in addition to the effects of the above tenth feature, since a spring as a driving force for moving the pickup feeding means, is provided along the direction in which the parallel movement type transmitting element moves, it is possible to promote a configuration thinner with respect to the direction of the sheet thickness, compared to the configuration where the spring is engaged with a rotary type driving force transmitting element.

In accordance with the twelfth feature of the invention, in addition to the effects of the above tenth feature, since, when a spring as a driving force for moving the pickup feeding means is engaged with the rotary type driving force transmitting element, the spring will no longer buckle, the movement of the pickup feeding means can be stabilized.

In accordance with the thirteenth feature of the invention, the following effects can be obtained. That is, in the prior art disclosed in Japanese Patent Publication Hei 6 No. 71,947, the stopper means supported by the supporting portion having a pivot axle on the separation feeding means side, rotationally moves up and down between the retracted position (inactive position) over the sheet stacking means and the blocking position (active position) with its lower end lowered. Compared to this configuration, in this invention, the sheet feeding means can be made thinner by the space which would be required for the path of the supporting portion of the stopper means as it rotates. Further, in this configuration, no erroneous displacement of the stopper means, stemming from the fact that the stopper means rotates about a rotary axle, will occur any longer, to thereby prevent erroneous feed of sheets.

Since the stopper means moves in parallel, the space of the path of the movement of the stopper means itself is also relative small, so this also contributes to miniaturizing the sheet feeder.

In accordance with the fourteenth feature of the invention, the following effects can be obtained in addition to the effects from the above thirteen features. That is, the rotary driving force transmitting element is arranged, within the space enclosed by the two planes, which are perpendicular to the direction of the sheet thickness which are formed so as to be in contact with the space of the path for movement of the stopper means between the blocking position and the retracted position, and on the side opposite to the sheet blocking side of the stopper means, and the mechanism of transmitting a driving force to move the stopper means between the blocking position and the retracted position is configured in such a geometry that, within the space enclosed by the aforementioned two planes, the parallel movement type drive transmitting element which is integrally formed on the side opposite to the sheet blocking side of the stopper means for preventing the sheets from reaching the separation feeding means, receives a driving force from the rotary driving force transmitting element. Therefore, it is possible to easily arrange a rotary type transmission element which will not need moving space for drive transmission, in the space between the pickup feeding means and the separation feeding means, which would be difficult to arrange because drive transmission parts of the stopper means. On the other hand, the parallel movement type drive transmission element moves integrally with the sheet stopper means, so not to be an obstacle to the arrangement of the stopper. Thus, this configuration contributes to the miniaturization.

What is claimed is:

1. An image processing apparatus, comprising:

a plurality of functional units each having a predetermined function for processing an image, disposed in a predetermined position so as to be attachable and detachable with respect to an apparatus body, characterized in that each functional unit is disposed and attached in a space not including a space which is the path of any other unit during movement for attachment and detachment thereof; a space defined by translating a first functional unit in the attaching direction thereof can accommodate a part of a second functional unit.

2. The image processing apparatus according to claim 1, wherein one of the plurality of functional units has a first functional portion which directly comes in contact with sheets and directly relates to sheet feeding and a second functional portion which relates to sheet feeding but is kept away the sheets; the first functional unit is arranged for attachment within a space which is defined by translating an area extending in the direction perpendicular to a sheet feeding direction and having the full width of an acceptable maximum size sheet, in the direction normal to a sheet feeding surface; and/or the second functional unit is arranged for attachment within a space which is defined by translating an area lying in the direction perpendicular to the sheet feeding direction but outside the full width of the acceptable maximum size sheet, in the direction normal to the sheet feeding surface.

3. The image processing apparatus according to claim 1, wherein the first functional unit has a coupling means for coupling with the apparatus body or any other functional unit and at least a part of the coupling means disposed in a second functional unit.

4. The image processing apparatus according to claim 3, wherein multiple coupling means are classified and partitioned on the basis of the types of the coupling means.

5. The image processing apparatus according to claim 1, wherein the first functional unit is a container which can be modified in volume.

6. An image processing apparatus, comprising:

a plurality of functional units each having a predetermined function for processing an image, disposed in a predetermined position so as to be attachable and detachable with respect to an apparatus body, characterized in that each functional unit is disposed and attached in a space not including a space which is the path of any other unit during movement for attachment and detachment thereof; a space defined by overlapping of a space defined by translating a first functional unit in the attaching direction thereof and a space defined by translating the first functional unit in the detaching direction of a second functional unit can accommodate a part of the second functional unit.

7. The image processing apparatus according to claim 6, wherein one of the multiple functional units has a first functional portion which directly comes in contact with sheets and directly relates to sheet feeding but is kept away the sheets; the first functional unit is arranged for attachment within a space which is defined by translating an area extending in the direction perpendicular to a sheet feeding direction and having a full width of an acceptable maximum size sheet, in the direction normal to a sheet feeding surface; and/or the second functional unit is arranged for attachment within a space which is defined by translating an area lying in the direction perpendicular to the sheet feeding direction but outside the full width of the acceptable maximum size sheet, in the direction normal to the sheet feeding surface.

8. The image processing apparatus according to claim 6, wherein the first functional unit has a coupling means for coupling with the apparatus body or any other functional unit and at least a part of the coupling means disposed in a second functional unit.

9. The image processing apparatus according to claim 6, wherein the first functional unit is a container which can be modified in volume.

10. An image processing apparatus, comprising:

a plurality of functional units each having a predetermined function for processing an image, disposed in a predetermined position so as to be attachable and detachable with respect to the apparatus body, characterized in that each functional unit is disposed and attached in a space not including a space which is the path of any other unit during movement for attachment and detachment thereof; a space defined by overlapping of a space defined by translating a first functional unit in the attaching direction thereof and a space defined by translating the first functional unit in a direction substantially perpendicular to the attaching direction thereof, excluding a space occupied by the first function unit, can accommodate a part of the second functional unit.

11. The image processing apparatus according to claim 10, wherein one of the multiple functional units has a first functional portion which directly comes in contact with sheets and directly relates to sheet feeding and a second functional portion which relates to sheet feeding but is kept away the sheets; the first functional is arranged for attachment within a space which is defined by translating an area extending in the direction perpendicular to a sheet feeding direction and having the full width of an acceptable maximum size sheet, in the direction normal to a sheet feeding surface; and/or the second functional unit is arranged for attachment within a space which is defined by translating an area lying in the direction perpendicular to sheet feeding direction but outside the full width of the acceptable maximum size sheet, in the direction normal to the sheet feeding surface.

12. The image processing apparatus according to claim 10, wherein the first functional unit has a coupling means for coupling with the apparatus body or any other functional unit and at least a part of the coupling means disposed in a second functional unit.

13. The image processing apparatus according to claim 10, wherein the first functional unit is a container which can be modified in volume.

14. A sheet feeder comprising:

a sheet stacking means for stacking sheets;

a sheet-feeding related means which is movable between the active position of the sheet feeding action and the inactive position unrelated to the sheet feeding action; and a transmitting element for transmitting the driving force for moving the sheet-feeding related means between the active position and inactive position, characterized in that, when, in a space defined by translating the mid area of the full width of the acceptable maximum size sheet to be set on the sheet stacking means in the direction of the sheet thickness of the sheets stacked on the sheet stacking means, a space of the path of the sheet feeding related means for movement between its active and inactive positions, is arranged between two planes perpendicular to the direction of the sheet thickness, the transmitting element is arranged in the space enclosed by two planes; and the transmitting element is extended to a space which is defined by translating a boundary area of the full width of the acceptable maximum size sheet to be set on the sheet stacking means in the direction of the sheet thickness, or is extended to a space which is defined by translating an area beyond the full width of the acceptable maximum size sheet to be set on the sheet stacking means in the direction of the sheet thickness.

15. The sheet feeder according to claim 14, wherein the sheet stacking means, sheet feeding related means and transmitting element can be attached and detached with respect to the main body; a space overlapped between the space which is defined by translating a boundary area of the full width of the acceptable maximum size sheet to be set on the sheet stacking means, in the direction of the sheet thickness and/or the space which is defined by translating an area beyond the full width of the acceptable maximum size sheet to be set on the sheet stacking means, in the direction of the sheet thickness, and a space which is defined by translating the space of the path of the sheet feeding related means for movement between its active and inactive positions, in the direction of sheet width, is occupied by the transmitting element and a part of the drive source for driving the transmitting element.

16. A sheet feeder comprising:

a sheet stacking means for stacking sheets;

a pickup feeding means which is supported by a supporting portion so as to be movable between a sheet feeding position where it comes in contact with the sheet stacked on the sheet stacking means and a retracted position where it is kept away from the sheet;

a first driving system, which provides a driving force to the supporting portion so as to shift the pickup feeding means between the sheet feeding position and the retracted position;

a second driving system for providing a driving force to the pickup feeding means;

a separation feeding means for separating the sheets which are fed by the pickup means, at the sheet feeding position, driven by the driving force from the second driving system, one by one, and delivering the separated sheet to the downstream side with respect to the sheet feeding direction;

a third driving system which provides a driving force to the separation feeding means to cause the separation feeding means to separate sheets, one by one; and a control means for controlling the first, second and third driving systems so that the sheets stacked on the sheet stacking means can be delivered, characterized in that the first driving system comprises: a rotary driving force transmitting element and a parallel movement type driving force transmitting element coupled to the rotary driving force transmitting element, and the rotary driving force transmitting element is disposed closer to the pickup feeding means than the parallel movement type transmitting element.

17. The sheet feeder according to claim 16, wherein the first driving system further comprises an urging spring urging the parallel movement type driving force transmitting element, in the direction opposing the driving force from the drive source; and the urging spring is provided along the direction in which the parallel movement type transmitting element moves, and is engaged with the parallel movement type transmitting element.

18. The sheet feeder according to claim 16, wherein the first driving system further comprises a compression spring urging the rotary driving force transmitting element, in the direction opposing to the driving force from the drive source; and the compression spring is engaged between the fixed side and the rotary driving force transmitting element, via a rotatable supporting means.

19. A sheet feeder comprising:

a sheet stacking means for stacking sheets;

a pickup feeding means which is supported by a supporting portion so as to be movable between a sheet feeding position where it comes in contact with the sheet stacked on the sheet stacking means and a retracted position where it is kept away from the sheet;

a first driving system, which provides a driving force to the supporting portion so as to shift the pickup feeding means between the sheet feeding position and the retracted position;

a second driving system for providing a driving force to the pickup feeding means;

a separation feeding means for separating the sheets which are by the pickup means, at the sheet feeding position, driven by the driving force from the second driving system, one by one, and delivering the separated sheet to the downstream side with respect to the sheet feeding direction;

a third driving system which provides a driving force to the separation feeding means to cause the separation feeding means to separate sheets, one by one;

a stopper means which is movable between the blocking position for stopping the sheets stacked on the sheet stacking means, from moving toward the separation feeding means, and the retracted position for allowing the sheets stacked on the sheet stacking means to be fed;

a fourth driving system for driving the stopper means between the blocking position and the retracted position; and a control means for controlling the first, second, third and fourth driving systems so that the sheets stacked on the sheet stacking means can be delivered, characterized in that the stopper means is lowered under the sheet stacking surface of the sheet stacking means when it is at the retracted position, and is moved in parallel in the direction crossing to the sheet stacking surface when the stopper means moves between the blocking position and the retracted position.

20. The sheet feeder according to claim 19, wherein the fourth driving system comprises a parallel movement type driving force transmitting element integrally provided on the side opposite to the sheet blocking side of the stopper means, and a rotary driving force transmitting element which abuts the parallel movement type driving force transmitting element to transmit the driving force; and when two planes perpendicular to the direction of the sheet thickness are formed so as to be in contact with a space of the path for movement of the stopper means between the blocking position and the retracted position, the rotary driving force transmitting element is arranged within the space enclosed by the two planes and in the side opposite to the sheet blocking side of the stopper means.

21. An image processing apparatus comprising:

an apparatus body;

a first functional unit which is attached to the apparatus body in a first predetermined position, and which is attachable and detachable with respect to the apparatus body by movement in a path in first attachment and detachment directions, respectively; and a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path;

wherein the first attachment direction is different than the second attachment direction and the first detachment direction is different than the second detachment direction; and wherein a part of the second functional unit occupies a space defined by translating the first functional unit in its attaching direction.

22. The image processing apparatus according to claim 21, wherein the first attachment direction is substantially perpendicular to the second attachment direction and the first detachment direction is substantially perpendicular to the second detachment direction.

23. An image processing apparatus comprising:

an apparatus body;

an image processing unit;

a first functional unit which is attached to the apparatus body in a first predetermined position, and which is attachable and detachable with respect to the apparatus body by movement in a path in first attachment and detachment directions, respectively;

a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path;

wherein the first attachment direction is different than the second attachment direction and the first detachment direction is different than the second detachment direction;

wherein the second functional unit is a feeder which feeds sheets to the image processing unit; and wherein a part of the feeder occupies a space defined by translating the first functional unit in its attaching direction.

24. An image processing apparatus comprising:

an apparatus body;

an image processing unit;

a first functional unit which is attached to the apparatus body in a first predetermined position, and which is attachable and detachable with respect to the apparatus body by movement in a path in first attachment and detachment directions, respectively;

a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path;

wherein the first attachment direction is different than the second attachment direction and the first detachment direction is different than the second detachment direction;

wherein the second functional unit is a feeder which feeds sheets to the image processing unit; and wherein the first functional unit is a container which collects developer unused by the image processing unit.

25. An image processing apparatus comprising:

an apparatus body;

an image processing unit;

a first functional unit which is attached to the apparatus body in a first predetermined position, and which is attachable and detachable with respect to the apparatus body by movement in a path in first attachment and detachment directions, respectively;

a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path;

wherein the first attachment direction is different than the second attachment direction and the first detachment direction is different than the second detachment direction;

wherein the second functional unit is a feeder which feeds sheets to the image processing unit; and wherein the first functional unit is container which collects developer unused by the image processing unit.

26. An image processing apparatus comprising:

an apparatus body;

a first functional unit which is attached to the apparatus body in a first predetermined position, and which is attachable and detachable with respect to the apparatus body by movement in a path in first attachment and detachment directions, respectively; and a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path;

wherein the first attachment direction is different than the second attachment direction and the first detachment direction is different than the second detachment direction; and wherein a part of the second functional unit occupies a space defined by the overlap between a space defined by translating the first functional unit in its attaching direction and a space defined by translating the first functional unit in the detaching direction of the second functional unit.

27. The image processing apparatus according to claim 26, wherein the first attachment direction is substantially perpendicular to the second attachment direction and the first detachment direction is substantially perpendicular to the second detachment direction.

28. The image processing apparatus according to claim 26, further comprising an image processing unit and wherein the second functional unit is a feeder which feeds sheets to the image processing unit.

29. The image processing apparatus according to claim 28, further comprising an image processing unit and wherein the first functional unit is container which collects developer unused by the image processing unit.

30. The image processing apparatus according to claim 26, further comprising an image processing unit and wherein the first functional unit is container which collects developer unused by the image processing unit.

31. An image processing apparatus comprising:

an apparatus body;

a first functional unit which is attached to the apparatus body in a first predetermined position, and which is attachable and detachable with respect to the apparatus body by movement in a path in first attachment and detachment directions, respectively; and a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path;

wherein the first attachment direction is different than the second attachment direction and the first detachment direction is different than the second detachment direction; and wherein a part of the second functional unit occupies a space defined by an overlap between of a space defined by translating the first functional unit in its attaching direction and a space defined by translating the first functional unit in a direction substantially perpendicular to the attaching direction thereof, and wherein the space occupied by the part of the second functional unit excludes the predetermined position of the first functional unit.

32. The image processing apparatus according to claim 31, wherein the first attachment direction is substantially perpendicular to the second attachment direction and the first detachment direction is substantially perpendicular to the second detachment direction.

33. The image processing apparatus according to claim 32, further comprising an image processing unit and wherein the second functional unit is a feeder which feeds sheets to the image processing unit.

34. The image processing apparatus according to claim 33, further comprising an image processing unit and wherein the first functional unit is container which collects developer unused by the image processing unit.

35. The image processing apparatus according to claim 31, further comprising an image processing unit and wherein the first functional unit is container which collects developer unused by the image processing unit.

36. An image processing apparatus, comprising:

an apparatus body;

a first functional unit which is attached to the apparatus body in a first predetermined position, and which is attachable and detachable with respect to the apparatus body by movement in a path in first attachment and detachment directions, respectively; and a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path; and wherein a part of the second functional unit occupies a space defined by translating the first functional unit in its attaching direction.

37. An image processing apparatus, comprising:

an apparatus body;

a first functional unit which is attached to the apparatus body in a first predetermined position, and which is attachable and detachable with respect to the apparatus body by movement in a path in first attachment and detachment directions, respectively; and a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path; and wherein a part of the second functional unit occupies a space defined by the overlap between a space defined by translating the first functional unit in its attaching direction and a space defined by translating the first functional unit in the detaching direction of the second functional unit.

38. An image processing apparatus, comprising:

an apparatus body;

a first functional unit which is attached to the apparatus body in a first predetermined position, and which is attachable and detachable with respect to the apparatus body by movement in a path in first attachment and detachment directions, respectively; and a second functional unit which is attached to the apparatus body in a second predetermined position, and which is attachable and detachable with respect to the apparatus body by movement in a path in second attachment and detachment direction, respectively;

wherein the first predetermined position is non-interfering with a space defined by the movement of the second functional unit in its attachment/detachment path and wherein the second predetermined position is non-interfering with a space defined by movement of the first functional unit in its attachment/detachment path; and wherein a part of the second functional unit occupies a space defined by an overlap between of a space defined by translating the first functional unit in its attaching direction and a space defined by translating the first functional unit in a direction substantially perpendicular to the attaching direction thereof, and wherein the space occupied by the part of the second functional unit excludes the predetermined position of the first functional unit.

* * * * *